US009897943B2

(12) United States Patent
Fujita et al.

(10) Patent No.: US 9,897,943 B2
(45) Date of Patent: Feb. 20, 2018

(54) BELT UNIT, TRANSFER UNIT, AND IMAGE FORMING APPARATUS INCLUDING A PRESSING MEMBER THAT PRESSES AN EDGE OF A BELT

(71) Applicants: Junpei Fujita, Kanagawa (JP); Naohiro Kumagai, Kanagawa (JP); Seiichi Kogure, Kanagawa (JP); Kazuki Yogosawa, Tokyo (JP); Kenji Sugiura, Kanagawa (JP); Yuuji Wada, Kanagawa (JP); Yusuke Mitani, Kanagawa (JP)

(72) Inventors: Junpei Fujita, Kanagawa (JP); Naohiro Kumagai, Kanagawa (JP); Seiichi Kogure, Kanagawa (JP); Kazuki Yogosawa, Tokyo (JP); Kenji Sugiura, Kanagawa (JP); Yuuji Wada, Kanagawa (JP); Yusuke Mitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/660,128

(22) Filed: Mar. 17, 2015

(65) Prior Publication Data

US 2015/0268591 A1 Sep. 24, 2015

(30) Foreign Application Priority Data

Mar. 18, 2014 (JP) ..... 2014-055161
Jul. 28, 2014 (JP) ..... 2014-153228

(51) Int. Cl.
*G03G 15/00* (2006.01)
*G03G 15/16* (2006.01)

(52) U.S. Cl.
CPC ..... *G03G 15/161* (2013.01); *G03G 15/1615* (2013.01)

(58) Field of Classification Search
CPC ..... G03G 15/161; G03G 15/1615; G03G 15/1605; G03G 15/0136; G03G 15/2053; G03G 2215/0129; G03G 2215/2035; G03G 2215/0193
USPC ..... 399/121
See application file for complete search history.

(56) References Cited

U.S. PATENT DOCUMENTS

2011/0058859 A1 3/2011 Nakamatsu et al.
2011/0064487 A1 3/2011 Ichihashi et al.
2011/0103822 A1* 5/2011 Sugiura ..... G03G 15/161 399/101
2011/0286759 A1 11/2011 Ichihashi et al.
(Continued)

FOREIGN PATENT DOCUMENTS

JP 2005-309181 11/2005
JP 2005309181 * 11/2005
JP 2011-137988 7/2011

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A belt unit is detachably attachable to a body of an image forming apparatus. The belt unit includes a belt, a pressing member, and a frame. The belt is wound around a plurality of supports to travel in a belt travel direction. The belt includes a base layer and an elastic layer. The pressing member presses warping on an edge of the belt. The frame supports the plurality of supports. The pressing member is positioned on the frame.

26 Claims, 27 Drawing Sheets

(56) References Cited

U.S. PATENT DOCUMENTS

| | | | | |
|---|---|---|---|---|
| 2011/0293312 | A1 | 12/2011 | Mimbu et al. | |
| 2012/0237260 | A1* | 9/2012 | Sengoku | G03G 15/161 399/162 |
| 2013/0114982 | A1 | 5/2013 | Ichihashi et al. | |
| 2015/0055981 | A1 | 2/2015 | Fujita et al. | |

* cited by examiner $$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

BELT UNIT, TRANSFER UNIT, AND IMAGE FORMING APPARATUS INCLUDING A PRESSING MEMBER THAT PRESSES AN EDGE OF A BELT

CROSS-REFERENCE TO RELATED APPLICATIONS

This patent application is based on and claims priority pursuant to 35 U.S.C. § 119(a) to Japanese Patent Application Nos.2014-055161, filed on Mar. 18, 2014, and 2014-153228, filed on Jul. 28, 2014 in the Japan Patent Office, the entire disclosure of each of which is hereby incorporated by reference herein.

BACKGROUND

Technical Field

Embodiments of this disclosure relate to a belt unit including a belt, a transfer unit including a belt, and an image forming apparatus including the belt unit or the transfer unit.

Description of the Related Art

An image forming apparatus includes multiple units having various functions related to image formation within the apparatus body. These units are detachably supported in the apparatus body for the purpose of maintenance, cleaning, exchange of parts, and exchange of units. Such units include a belt unit or a transfer unit including an endless belt that is wound around a plurality of support rollers, which serve as supports and are members used in image transfer and image fixing or in conveyance of paper sheet, which serves as a recording medium.

In such a belt unit or a transfer unit, in the case that a belt is used, if a belt made of a multi-layer material including a base material, an elastic layer, and the like is used, the edges of the belt positioned in the belt width direction may become warped due to the influence of heat deformation caused by differences in the thermal expansion coefficient of each layer or temporal degradation. If the belt edges become warped, depending on the level of warping, the attachment/detachment of one unit may interfere with another adjacent unit or the like, and this interference may lead to breakage of the belt or obstruction of the attachment/detachment operation. Hence, a configuration is proposed in which a pressing member is disposed in a direction of warping of the belt edges, and the pressing member is supported by a contact-and-separation assembly that moves the pressing member in the up-down direction as necessary so as to prevent the belt warping from becoming larger.

SUMMARY

In at least one aspect of this disclosure, there is provided a belt unit detachably attachable to a body of an image forming apparatus. The belt unit includes a belt, a pressing member, and a frame. The belt is wound around a plurality of supports to travel in a belt travel direction. The belt includes a base layer and an elastic layer. The pressing member presses warping on an edge of the belt. The frame supports the plurality of supports. The pressing member is positioned on the frame.

In at least one aspect of this disclosure, there is provided an image forming apparatus comprising the belt unit.

In at least one aspect of this disclosure, there is provided a belt unit detachably attachable to a body of an image forming apparatus. The belt unit includes a belt, a pressing member, a frame, a rotatable holder, and a contact-and-separation assembly. The belt is wound around a plurality of supports to travel in a belt travel direction. The pressing member presses warping on an edge of the belt. The frame supports the plurality of supports. The pressing member is mounted to the rotatable holder. The contact-and-separation assembly rotates the holder to rotate the pressing member toward and away from the belt. The pressing member is positioned on the frame via the contact-and-separation assembly.

In at least one aspect of this disclosure, there is provided a transfer unit includes a belt, a bracket, and a frame. The belt is wound around a plurality of rollers having a surface on which an image is transferred. The bracket has an opposing face opposing the surface of the belt outside a region in which the image is transferred, in a belt width direction. The frame rotatably supports the plurality of rollers. The transfer unit is drawable in the belt width direction from a body of an image forming apparatus. The frame includes a shaft. The bracket includes a hole. The bracket is rotatably supported on the frame with the shaft inserted into the hole.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
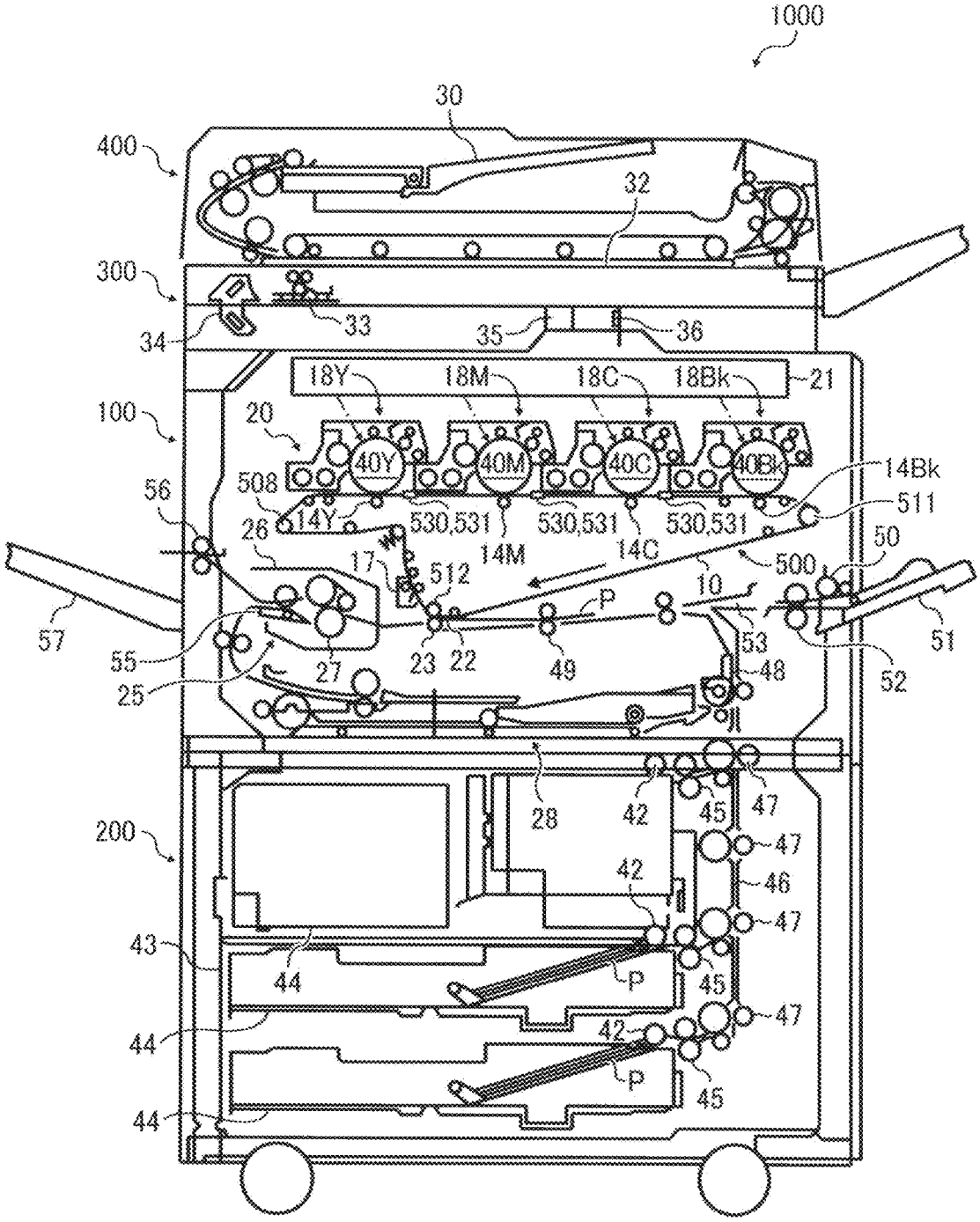
FIG. 1 is a schematic view of a configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, multiple embodiments of the present disclosure will be described sequentially below. In the following embodiments, the same reference codes are allocated to elements (members or components) having the same function or configuration and redundant descriptions thereof are omitted below. The drawings may be partially omitted in order to facilitate the understanding of a partial configuration. The present invention is characterized in that a pressing member that presses the warping of a belt capable of a contact-and-separation operation is provided on a unit that supports the belt, and the pressing member is also capable of contact-and-separation movement in accordance with the contact-and-separation movement of the belt.

As shown in FIG. 1, an image forming apparatus 1000 according to the present embodiment is a color copier. In FIG. 1, the image forming apparatus 1000, e.g., includes a copier body (copier housing) 100, which is a body (housing) of an image forming apparatus, a sheet feed table 200, a scanner 300, and an automatic document feeder. The copier body 100 is placed on the sheet feed table 200. The scanner 300 serves as an image reading unit and is mounted on the copier body 100. The automatic document feeder 400 is mounted on the scanner 300. In the center of the copier body 100, a transfer unit 500, which is a functional unit including a transfer belt (intermediate transfer belt) 10 that serves as an intermediate transfer body and is an endless belt member, is provided. The transfer belt 10 is wound around a plurality of rollers, which serve as a plurality of supports, and can travel by rotating clockwise in FIG. 1. The arrow indicated by V shows the travel direction of the transfer belt 10. On the periphery of the transfer belt 10, an intermediate transfer body cleaning device 17 that removes residual toner on the transfer belt 10 after image transfer is disposed. Above the transfer unit 500, four process cartridge units 18Bk, 18C, 18M, and 18Y of black, cyan, magenta, and yellow are aligned horizontally from a downstream side in the travel direction along the travel direction V. These four process cartridge units 18Bk, 18C, 18M, and 18Y constitute a tandem image forming unit 20. An exposure device 21 is disposed above the tandem image forming unit 20. Each process cartridge unit is a functional unit, and includes a drum-shaped photoconductor 40Bk, 40C, 40M, or 40Y, which serves as an image bearer. Each process cartridge unit functions to form a toner image using toner, which serves as a developer, of each color on each photoconductor by a functional member of a well-known electrophotographic process, and cleans the surface of the photoconductor after toner image transfer. The process cartridge units are provided adjacent to the transfer unit 500 with a gap therebetween. The process cartridge units and the transfer unit 500 are detachably supported in the copier body 100.

A secondary transfer roller 23, which serves as a secondary transfer member, is disposed on the opposite side of the tandem image forming unit 20 sandwiching the transfer belt 10 therebetween. The secondary transfer roller 23 is pushed via the transfer belt 10 against a secondary opposing roller 512, which serves as a secondary transfer opposing member, that supports the transfer belt 10 from the inside, so as to form a secondary transfer portion (nipping portion) 22 a contact portion of the secondary transfer roller 23 and the secondary opposing roller 512. In the secondary transfer portion (nipping portion) 22, the application of a transfer bias causes a toner image or composite color image on the transfer belt 10 to be transferred to a paper sheet P, which serves as a sheet-shaped recording medium. A fixing device 25 that fixes an image that has been transferred to the paper sheet P is disposed on a downstream side in a paper conveyance direction from the secondary transfer roller 23. The fixing device 25 pushes a pressure roller 27, which serves as a pressure member, against a fixing belt 26, which is a belt that serves as a fixing member, and the fixing device 25 is detachably supported in the copier body 100. The fixing device 25 includes a belt, and thus the pressing member capable of contact-and-separation movement of the present invention can be applied to the fixing device 25. As the secondary transfer opposing member, instead of a roller, an endless belt wound around a plurality of rollers can also be used. In the present embodiment, a contact scheme in which the secondary transfer member is made to contact the transfer belt 10 is adopted, but a non-contact charger can also be disposed as the secondary transfer member. In this case, since it is difficult to provide such a non-contact charger together with a paper conveyance function achieved by rollers and belts, a conveyance unit may be provided separately. In the example of FIG. 1, a sheet reverse device 28 that reverses the paper sheet P to which an image is to be recorded on both sides thereof is disposed under the secondary transfer portion (nipping portion) 22 and the fixing device 25 parallel to the above-mentioned tandem image forming unit 20, and thus the example of FIG. 1 can be adapted to duplex printing. In the case of only simplex printing, the sheet reverse device 28 can be eliminated. The color copier can also function as a printer that is connectable either via wires or wirelessly to an external terminal such as a computer. The image forming apparatus is not limited to a color copier or printer, and a facsimile machine or a multifunction peripheral equipped with at least two functions such as a copier, a printer, and a facsimile machine can also be used.

When using a color copier to obtain a color copy, a color document is set on a document table 30 of the automatic document feeder 400. Alternatively, the automatic document feeder 400 is opened and a color document is set onto an exposure glass 32 of the scanner 300, and then the automatic document feeder 400 is closed to press the color document. When a start key is pressed, the scanner 300 is driven after the document is conveyed and moved onto the exposure glass 32 in the case that the document is set in the automatic document feeder 400, or the scanner 300 is driven immediately in the case that the document is set on the exposure glass 32, and then a first traveling body 33 and a second traveling body 34 are made to travel. Light is irradiated from a light source with the first traveling body 33 and light that is reflected from the document surface is further reflected toward the second traveling body 34. The light is reflected by a mirror of the second traveling body 34, passes through an imaging lens 35, and enters a reading sensor 36, and thereby the content of the document is read.

When the start key is pressed, the transfer belt 10 rotatably travels in a clockwise direction by a driving motor. Simultaneously, the photoconductors 40Bk, 40C, 40M, and 40Y of the process cartridge units 18Bk, 18C, 18M, and 18Y are rotatably driven, and single-color toner images of black, yellow, magenta, and cyan are formed on the respective photoconductors 40. These single-color toner images are sequentially transferred onto the transfer belt 10 as the transfer belt 10 travels to form a composite color image.

Meanwhile, when the start key is pressed, one of a plurality of sheet feed rollers 42 of the sheet feed table 200 is selectively rotated to dispense a paper sheet P from one of a plurality of sheet feeding cassettes 44 which are provided in multiple stages in a paper bank 43. The paper sheet P that is dispensed is separated sheet-by-sheet by separation rollers 45 and enters a sheet feed path 46, and then is conveyed by conveyance rollers 47, guided to a sheet feed path 48 within the copier body 100, and then hits registration rollers 49 and is stopped. Alternatively, a sheet feed roller 50 is rotated to dispense a paper sheet P on a bypass tray 51, and then the paper sheet P is separated sheet-by-sheet by separation rollers 52 and enters a bypass feed pathway 53, and then similarly hits the registration roller 49 and is stopped. The registration roller 49 is rotated to match the timing at which the composite color image on the transfer belt 10 reaches the secondary transfer portion 22, so as to send the paper sheet P to the secondary transfer portion 22 between the transfer belt 10 and the secondary transfer roller 23. In the secondary transfer portion 22, the composite color image is transferred all together onto the paper sheet P. In the case of obtaining a single-color copy, a toner image of a single color is formed and transferred to the transfer belt 10, and the toner image is then transferred onto the paper sheet P in the secondary transfer portion 22.

The paper sheet P after image transfer is then conveyed by the secondary transfer portion 22 and sent to the fixing device 25, where the transferred image is fixed by applying heat and pressure in the fixing device 25. Subsequently, the paper sheet P is switched by a switching pawl 55, ejected by an ejection roller 56, and stacked on a discharge tray 57. Alternatively, the paper sheet P after image transfer is switched by the switching pawl 55 and inserted into the sheet reverse device 28 where the paper sheet P is reversed and then guided again to the secondary transfer portion 22. After an image is transferred onto the backside of the paper sheet P, it is ejected onto the discharge tray 57 by the ejection roller 56. Meanwhile, after the image transfer, residual toner that remains on the transfer belt 10 after image transfer is removed by the intermediate transfer body cleaning device 17, and then the transfer belt 10 is provided for another image formation by the tandem image forming unit 20.

The transfer belt 10 used in the present embodiment is configured in a single layer or multiple layers of PVDF (vinylidene fluoride), ETFE (ethylene-tetrafluoroethylene copolymer), PI (polyimide), PC (polycarbonate), and the like. A conductive material such as carbon black is dispersed in the transfer belt 10. The volume resistivity of the transfer belt 10 is adjusted to a range of $10^8$ to $10^{12}$ Ωcm and the surface resistivity of the transfer belt 10 is adjusted to a range of $10^9$ to $10^{13}$ Ωcm. A release layer can be coated onto the surface of the transfer belt 10 as necessary. As a material for the coat, a fluororesin such as ETFE (ethylene-tetrafluoroethylene copolymer), PTFE (polytetrafluoroethylene), PVDF (vinylidene fluoride), PEA (perfluoroalkoxy fluororesin), FEP (tetrafluoroethylene-hexafluoropropylene copolymer), PVF (vinyl fluoride), and the like can be used, but the material for the coat is not limited thereto. As a method for manufacturing the transfer belt 10, roller coating, centrifugal molding, and the like can be implemented, and the surface of the transfer belt 10 can be polished as necessary. If the volume resistivity of the transfer belt 10 exceeds the above-mentioned range, it is not preferable because the bias necessary for transfer increases and this can lead to increases in the power costs. Also, the charging potential of the transfer belt 10 may increase in the transfer step, the transfer paper separation step, or the like and self electric discharge becomes difficult, and thus a neutralization unit would have to be provided. Further, if the volume resistivity and the surface resistivity fall below the above-mentioned ranges, damping of the charging potential becomes faster and this is advantageous in terms of neutralization by self electric discharge, but the current during transfer flows in a surface direction and thus toner scattering may occur. Therefore, the volume resistivity and the surface resistivity of the transfer belt 10 in the present invention are preferably within the above-mentioned ranges.

An elastic belt having a rubber layer can also be used as the transfer belt 10. By using an elastic belt, the transfer belt 10 is compressed at the secondary transfer portion (nipping portion) 22 such that any gaps with the paper sheet P having asperities or the like are filled, and thus the transferability is improved. With only a rubber layer, the stretch of the belt increases, and thus in the transfer belt 10, a resin layer such as a polyimide layer (PI layer) can be provided on a base layer. A layer having a low friction coefficient can also be provided on a surface layer of the transfer belt 10. The volume resistivity and the surface resistivity were measured by connecting an HRS probe (inside electrode diameter of 5.9 mm, ring electrode inner diameter of 11 mm) to a high resistance resistivity meter (made by Mitsubishi Chemical Corporation: HIRESTA-IP) and applying a voltage of 100V (a surface resistivity of 500 V) to the top and bottom of the transfer belt 10. The measured value after 10 seconds was used as the value of the volume resistivity and surface resistivity.

Figure 2A:
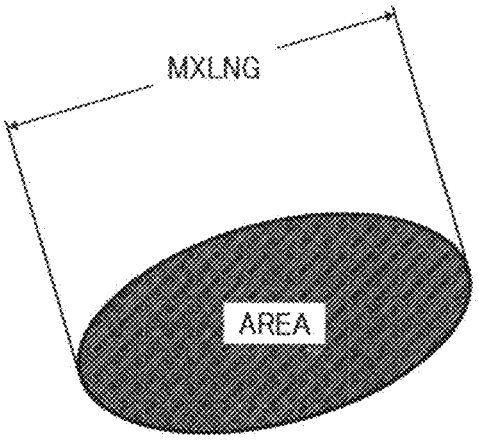
FIGS. 2A and 2B are enlarged views of characteristics of toner in a developer.
Figure 2B:
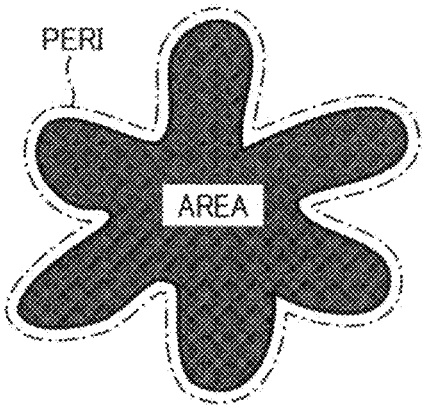

A shape factor SF-1 of the toner, which is a developer, used in image formation in the present embodiment is preferably in the range of 100 to 180, and a shape factor SF-2 thereof is preferably in the range of 100 to 180. FIG. 2 schematically represents the shape of the toner in order to explain the shape factor SF-1 and the shape factor SF-2. The shape factor SF-1 indicates a roundness ratio of the toner shape, and is represented by formula (1) below. The shape factor SF-1 is a value obtained by dividing the square of a maximum length MXLNG of a shape achieved by projecting the toner on a two-dimensional plane by a graphic form areas AREA, and then multiplying the result by 100π/4.

$$SF\text{-}1=\{(MXLNG)^2/AREA\}\times(100\pi/4) \quad \text{formula (1)}$$

If the value of SF-1 is 100, the toner shape is spherical, and the toner shape becomes more irregular as the value of SF-1 increases. The shape factor SF-2 indicates an unevenness ratio of the toner shape, and is represented by formula (2) below. The shape factor SF-2 is a value obtained by dividing the square of a peripheral length PERI of a graphic form achieved by projecting the toner on a two-dimensional plane by the graphic form area AREA, and then multiplying the result by 100/4π.

$$SF\text{-}2=\{(PERI)^2/AREA\}\times(100/4\pi) \quad \text{formula (2)}$$

If the value of SF-2 is 100, the toner surface has no unevenness, and the unevenness on the toner surface becomes more prominent as the value of SF-2 increases. These shape factors were specifically measured by capturing a toner image with a scanning electron microscope (S-800: from Hitachi, Ltd.), introducing the toner image into an image analyzer (LUSEX3: from Nireco Corporation), and then analyzing the toner image to calculate the shape factors.

If the toner shape approaches a sphere, the contact state between toner particles or between a toner particle and the photoconductors becomes point contact. Thus, the adsorption power between toner particles becomes weak and the liquidity increases. The adsorption power between a toner particle and the photoconductors also becomes weak and the transfer ratio increases. If one of the shape factors SF-1 and SF-2 exceeds 180, it is not preferable because the transfer ratio decreases and the cleaning performance when the toner adheres to the transfer member also deteriorates. Further, the toner particle diameter is preferably in a range of 4 to 10 μm in terms of volume-weighted average particle diameter. If the toner particle diameter is smaller than this range, background fog may occur during development, and the liquidity becomes worse. In addition, the toner easily agglomerates and thus dropout readily occurs. Conversely, if the toner particle diameter is larger than the above-mentioned range, a high definition image cannot be obtained due to toner scattering and poor resolution. In the present embodiment, a toner having a volume-weighted average particle diameter of 6.5 μm was used.

Figure 3:
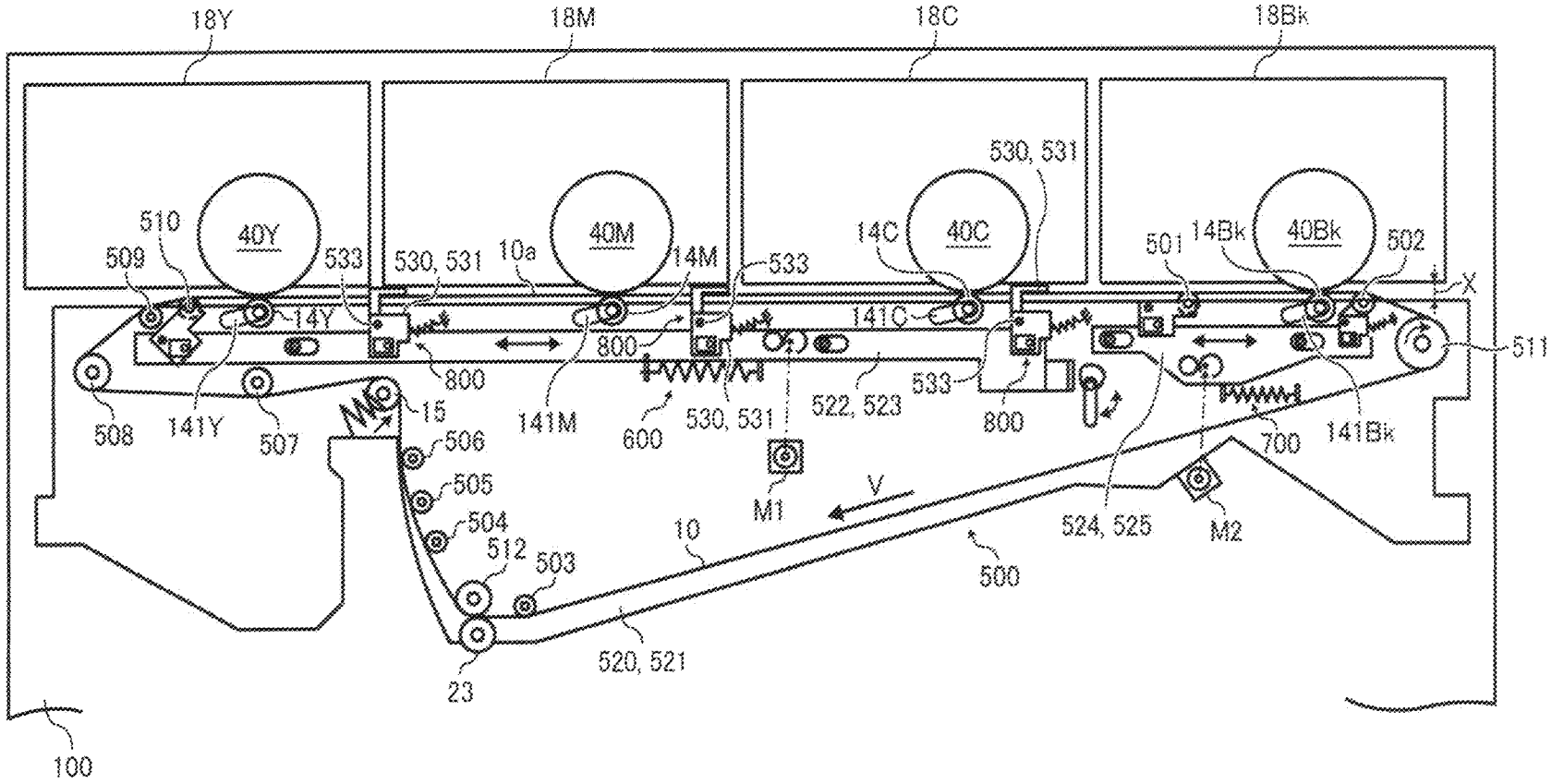
FIG. 3 is an enlarged view of a configuration of a transfer unit and a trajectory of a belt during a full color mode according to an embodiment of this disclosure.

Next, the transfer unit 500 will be explained in further detail. FIG. 3 is a schematic view of the process cartridge units 18Bk, 18C, 18M, and 18Y and the transfer unit 500 when viewed from the front side of the copier body. In FIG. 3, the transfer unit 500 includes first to tenth driven rollers 501 to 510, which serve as a plurality of supports, a driving motor 511, which serves as a support, the secondary opposing roller 512, and the transfer belt 10 that is wound around the rollers 501 to 512. The driving motor 511 and the driven roller 508 are disposed at the right end side and left end side of the copier body 100. The transfer belt 10 opposes the photoconductors 40Bk, 40C, 40M, and 40Y of the process cartridge units 18Bk, 18C, 18M, and 18Y on an upper side over which the transfer belt 10 is wound between the driving motor 511 and the driven roller 508. A tension roller 15 that compresses the transfer belt 10 from the outside toward the inside is positioned between the driven roller 506 and the driven roller 507. The driving motor 511 is rotatably driven in a clockwise direction in FIG. 3 by a driving motor M3, which serves as a driving source.

On the upper side of the transfer belt 10, the driven rollers 509, 510, 501, and 502 are disposed with intervals therebetween from the upstream side toward the downstream side in the belt travel direction. Inside the transfer belt 10, primary transfer rollers 14Bk, 14C, 14M, and 14Y as a primary transfer member are disposed at areas respectively opposing the photoconductors 40Bk, 40C, 40M, and 40Y. The primary transfer rollers 14Bk, 14C, 14M, and 14Y are provided such that they are movable by a contact-and-separation assembly between a contact position, which is a first position, at which a top surface 10*a* of the transfer belt 10 contacts the photoconductors 40Bk, 40C, 40M, and 40Y, and a separated position at which the top surface 10*a* of the transfer belt 10 is separated from the photoconductors 40Bk, 40C, 40M, and 40Y. The separated position includes a second position at which the primary transfer rollers 14Bk, 14C, 14M, and 14Y are located when a lubricant is applied to the transfer belt 10 and a third position at which the primary transfer rollers 14Bk, 14C, 14M, and 14Y are located when the transfer unit 500 is attached/detached to the copier body 100. The primary transfer rollers 14Bk, 14C, 14M, and 14Y are configured in a well-known manner in which they are respectively rotatably supported by support arms 141Bk, 141C, 141M, and 141Y that are swung by an electric driving source such as a driving motor which constitutes the contact-and-separation assembly, and held in the first to third positions by adjusting the angle of the support arms 141Bk, 141C, 141M, and 141Y with the driving motor. In other words, the transfer belt 10 is displaceable such that it can take multiple trajectories that are not parallel to each other.

The driven rollers 501, 502, and 509 which are parallel to the primary transfer rollers 14Bk, 14C, 14M, and 14Y are also provided to be movable between a contact position (first position) and a separated position (second and third positions). The movement of the driven rollers 501, 502, and 509 will be explained in more detail below.

In the present embodiment, the transfer unit 500 is configured such that the transfer belt 10 occupies four states (hereinafter referred to as "four modes"). The four modes are as follows: a full color mode in which the four photoconductors 40Bk, 40C, 40M, and 40Y of black, cyan, magenta, and yellow are used, a black mode in which only the black photoconductor 40Bk is used, a lubricant application mode in which lubricant is applied onto the transfer belt 10 in a stand-by state, and an attachment/detachment mode in which the transfer unit 500 is attached/detached to/from the copier body 100.

FIG. 3 illustrates the positional relationship of the transfer belt 10, the primary transfer rollers 14Bk, 14C, 14M, and 14Y, and the driven rollers 501, 502, and 510 during the full color mode. In the present embodiment, in the full color mode, the primary transfer rollers 14Bk, 14C, 14M, and 14Y and the driven rollers 501, 502, and 510 occupy the first position, and thereby the top surface 10*a* of the transfer belt 10 is in a contact state with all of the photoconductors 40Bk, 40C, 40M, and 40Y.

Figure 4:
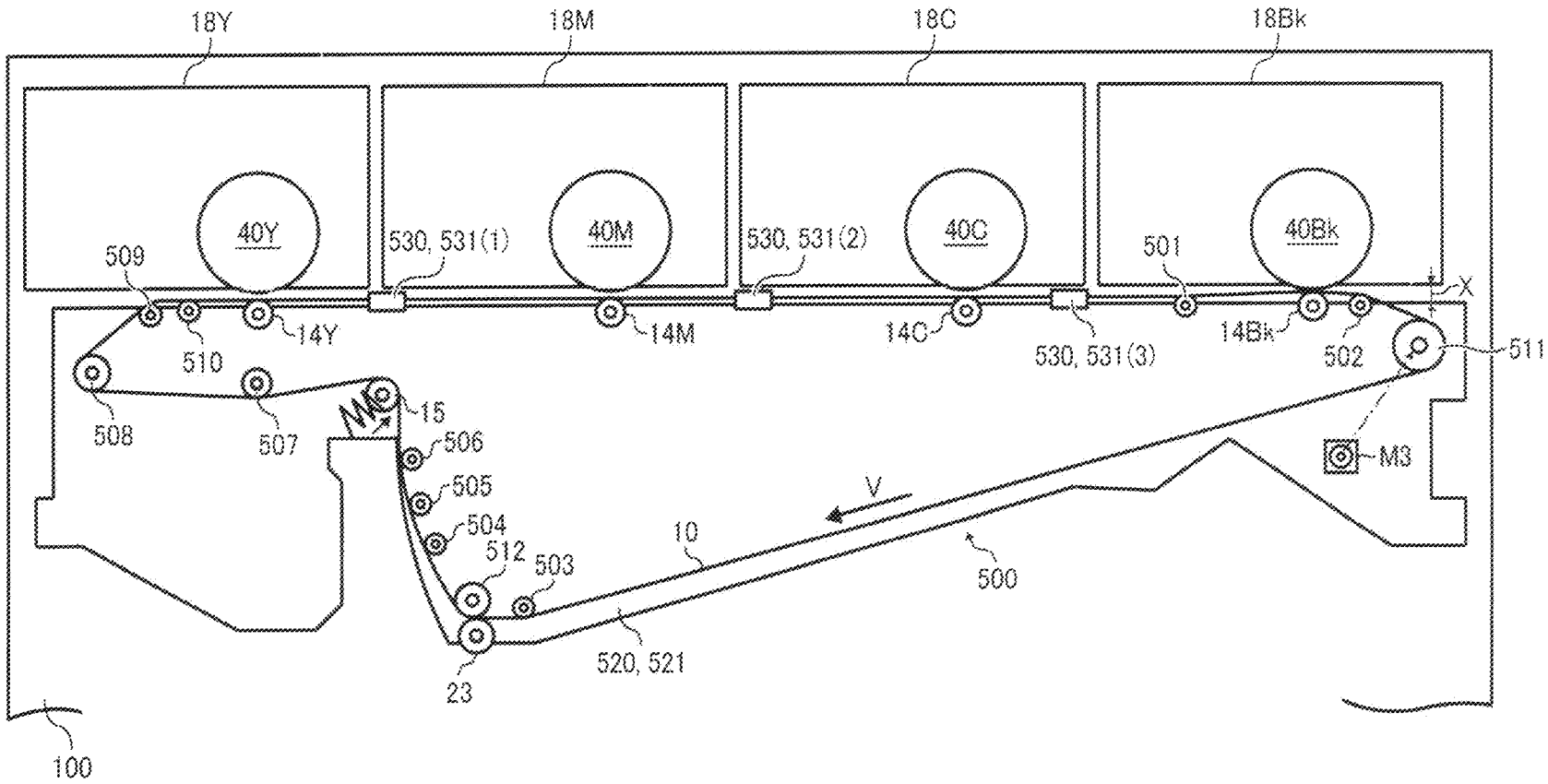
FIG. 4 is a schematic view of a trajectory of the belt during a black mode of the transfer unit shown in FIG. 3.

FIG. 4 illustrates the positional relationship of the transfer belt 10, the primary transfer rollers 14Bk, 14C, 14M, and 14Y, and the driven rollers 501, 502, and 510 during the black mode. In the present embodiment, in the black mode, the primary transfer roller 14Bk and the driven rollers 501 and 502 disposed in front of and behind the primary transfer roller 14Bk occupy the first position, and thereby the top surface 10*a* of the transfer belt 10 is in a contact state with the photoconductor 40Bk. The primary transfer rollers 14C, 14M, and 14Y and the driven roller 510 occupy the second position, which is the separated position, and thereby the top surface 10*a* of the transfer belt 10 is in a separated state from the photoconductors 40C, 40M, and 40Y. The transfer belt 10 at this time is in an inclined state in which the primary transfer roller 14Y side is lower based on the transfer portion formed between the transfer belt 10 and the primary transfer roller 14Bk. In other words, in the present embodiment, the trajectory of the transfer belt 10 in the mode in which the belt is separated is not parallel to the trajectory of the transfer belt 10 in the mode in which the belt is in contact.

Figure 5:
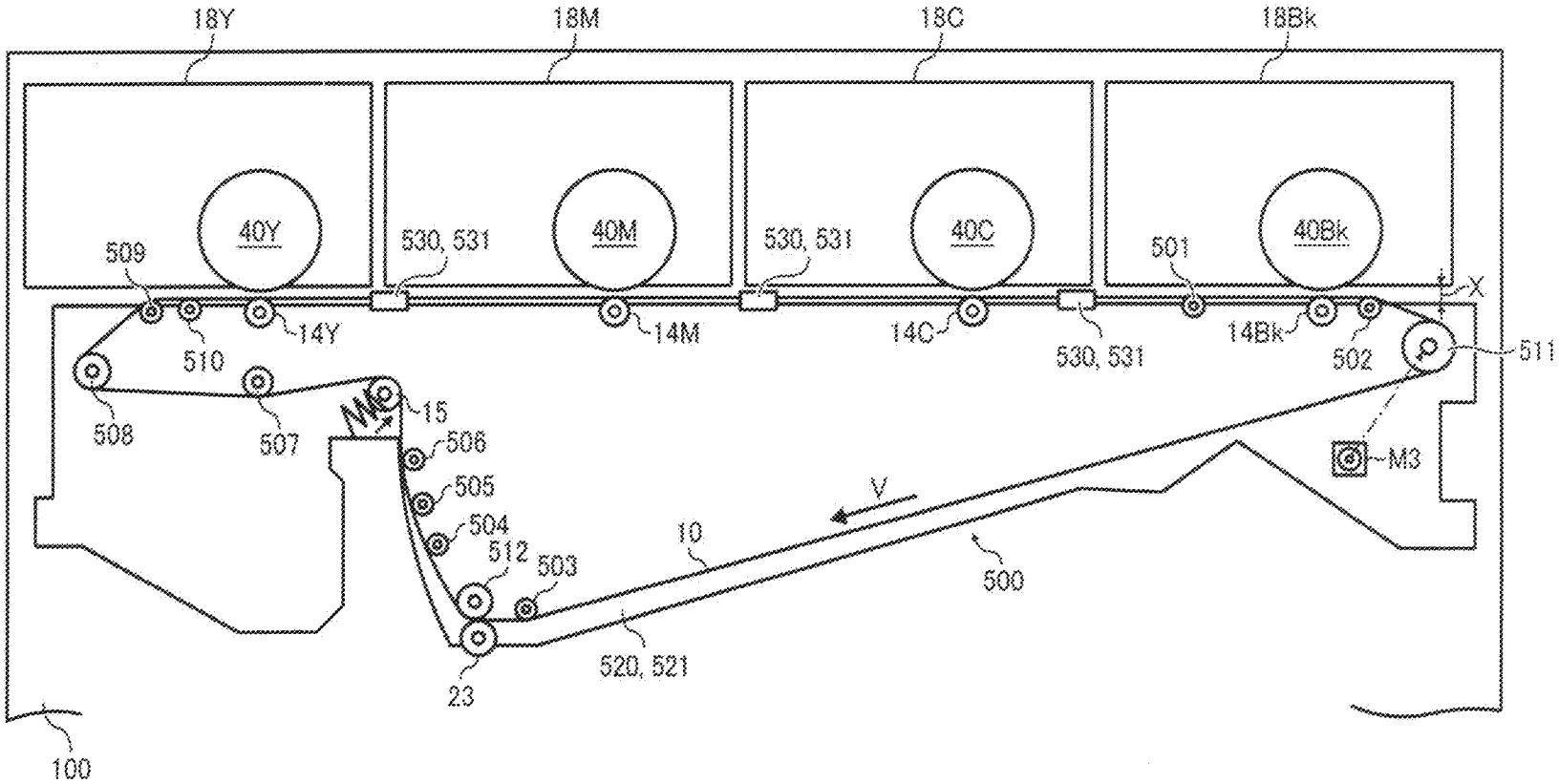
FIG. 5 is a schematic view of a trajectory of the belt during a lubricant application mode of the transfer unit shown in FIG. 3.

FIG. 5 illustrates the positional relationship of the transfer belt 10, the primary transfer rollers 14Bk, 14C, 14M, and 14Y, and the driven rollers 501, 502, and 510 during the lubricant application mode. In the present embodiment, in the lubricant application mode, the primary transfer rollers 14C, 14M, and 14Y and the driven roller 510 are held in the second position (separated position), and the primary transfer roller 14Bk and the driven rollers 501 and 502 occupy the second position (separated position). Therefore, the primary transfer rollers 14Bk, 14C, 14M, and 14Y and the driven rollers 501, 502, and 510 all occupy the second position, and thereby the top surface 10*a* of the transfer belt 10 is in a separated state from all of the photoconductors 40Bk, 40C, 40M, and 40Y.

Figure 6:
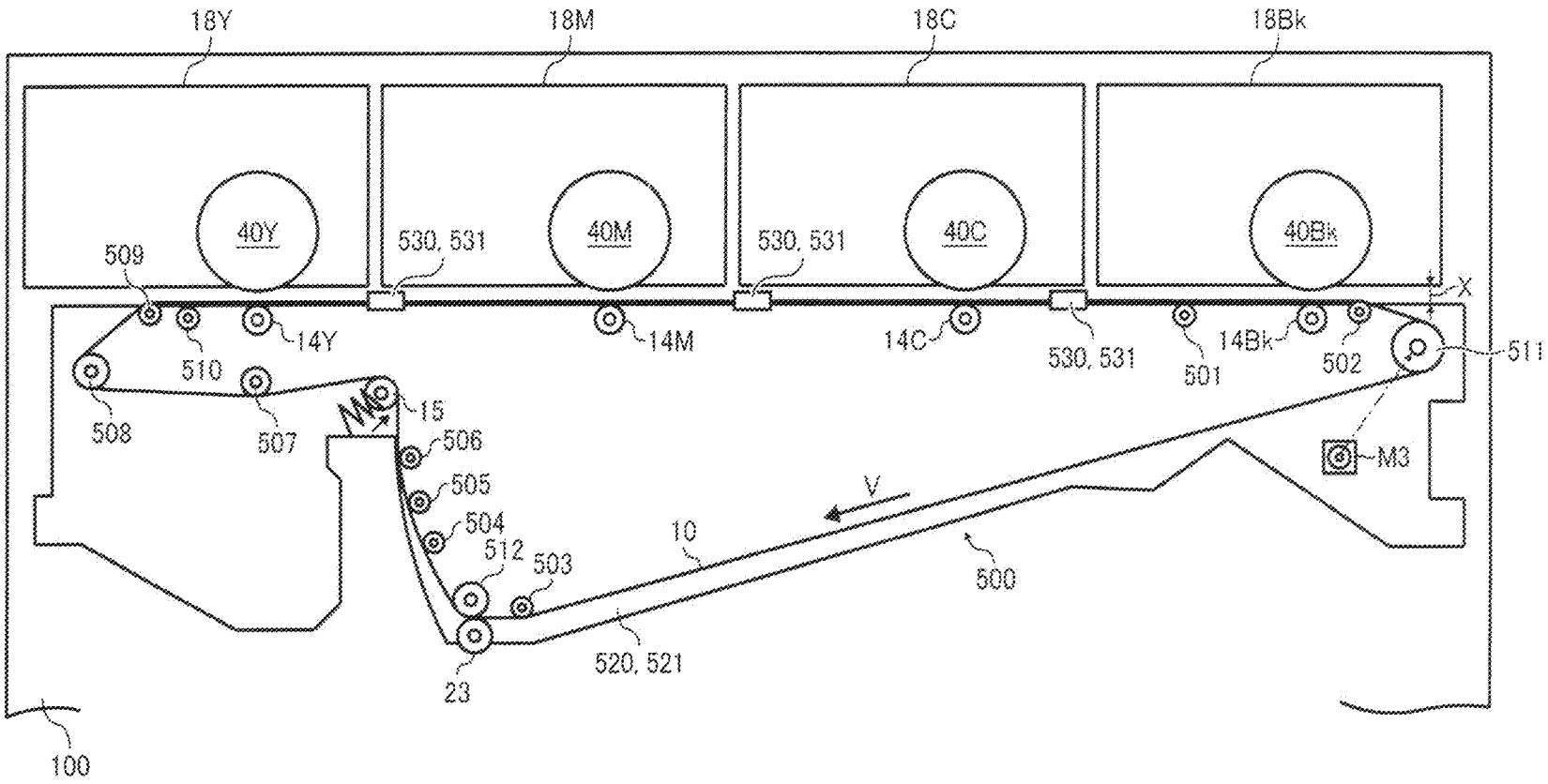
FIG. 6 is a schematic view of a trajectory of the belt during an attachment/detachment mode of the transfer unit shown in FIG. 3.

FIG. 6 illustrates the positional relationship of the transfer belt 10, the primary transfer rollers 14Bk, 14C, 14M, and 14Y, and the driven rollers 501, 502, and 510 during the attachment/detachment mode. In the present embodiment, in the attachment/detachment mode, the primary transfer rollers 14Bk, 14C, 14M, and 14Y and the driven rollers 501, 502, and 510 occupy the third position (separated position) at which they are separated further downwards from the photoconductors than in the application mode, and thereby the top surface 10*a* of the transfer belt 10 is in a further separated state from all of the photoconductors 40Bk, 40C, 40M, and 40Y than in the lubricant application mode. Herein, the second and third positions are provided as separated positions, but the third position can also be set as the second position so as to eliminate the second position.

As shown in FIGS. 3 to 6, a gap X is provided between the process cartridge units 18Bk, 18C, 18M, and 18Y and the transfer unit 500 in order to prevent interference between the units. In the present embodiment, the gap X is 6 mm. In the present embodiment, the separated state between the transfer belt 10 and the process cartridge units 18Bk, 18C, 18M, and 18Y is larger when the transfer belt 10 is in the separated position than in the contact position.

Figure 7A:
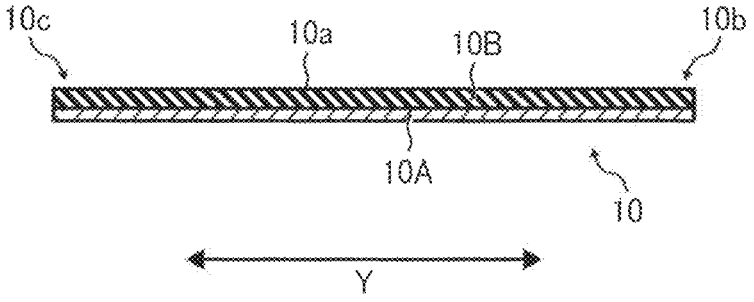
FIG. 7A is a cross-sectional view of a configuration of the belt.
Figure 7B:
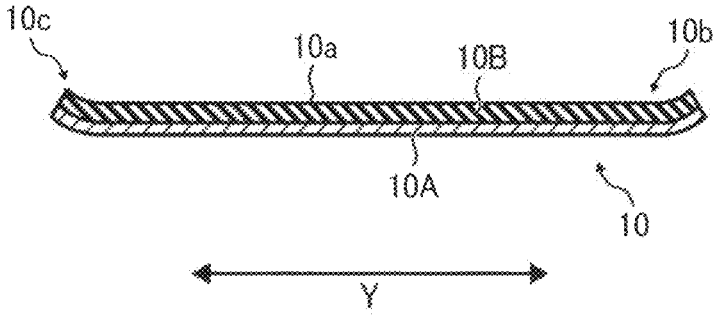
FIG. 7B is an enlarged view of a state in which warping has occurred on the edges of the belt.

In the present embodiment, as shown in FIG. 7A, the transfer belt 10 is made of an elastic belt having a base layer 10A and an elastic layer 10B. Thus, upwards warping (in an orientation in which the elastic layer 10B contracts) occurs easily at belt edges 10*b* and 10*c* located in a belt width direction Y, which is the axial direction of the photoconductors, as shown in FIG. 7B due to differences in the thermal expansion coefficient of the materials of the base layer 10A and the elastic layer 10B. If the warping at the belt edges 10*b* and 10*c* becomes larger than the gap X, the transfer belt 10 and the process cartridge units 18Bk, 18C, 18M, and 18Y may interfere with each other even if the transfer belt 10 is in the separated position when attaching/detaching the transfer unit 500 or the process cartridge units 18Bk, 18C, 18M, and 18Y to/from the copier body 100. In the case of the transfer belt 10 used in the present embodiment, warping of 14 to 19 millimeters occurred. If the gap X is increased, the above-described interference can be prevented. However, on the other hand, increasing the gap size may lead to an increase in the size of the copier body, or it may be difficult to increase the size of the gap X if the copier body is small.

Figure 8:
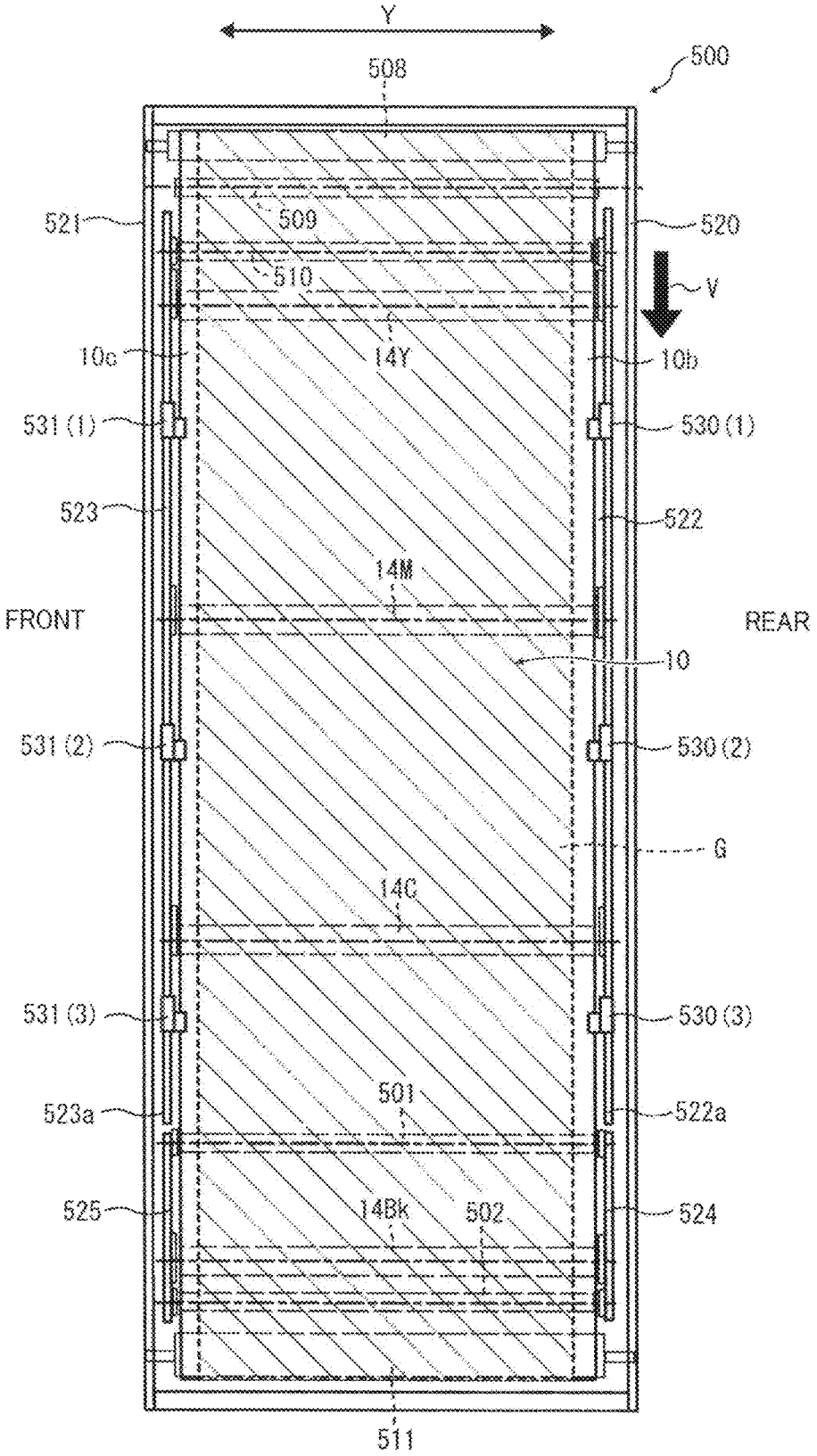
FIG. 8 is a schematic view of a configuration of a transfer unit according to an embodiment of this disclosure in a plan view.

Thus, in the present embodiment, as shown in FIG. 8, a pressing member 530 and a pressing member 531 that respectively oppose and press the belt edge 10*b* and the belt edge 10*c* are provided to the transfer unit 500. In the present embodiment, a plurality (three) of the pressing members 530 are disposed with intervals therebetween in the belt travel direction V on the belt edge 10*b* side, and a plurality (three) of the pressing members 531 are disposed with intervals therebetween in the belt travel direction V on the belt edge 10*c* side. The pressing members 530 and 531 are disposed to be positioned within the gap X on the belt edges 10*b* and 10*c* at positions outside of an image transfer region G of the transfer belt 10 indicated by diagonal lines. For the sake of convenience, the pressing members 530 and 531 positioned on the upstream side in the belt travel direction and disposed near the support roller 510 may also be referred to as the first pressing members 530(1) and 531(1), the pressing members 530 and 531 positioned on the downstream side in the belt travel direction and disposed near the support roller 501 may also be referred to as the third pressing members 530(3) and 531(3), and the pressing members 530 and 531 positioned between the first pressing members 530 and 531 and the third pressing members 530 and 531 may also be referred to as the second pressing members 530(2) and 531(2). The configurations of the first to third pressing members 530 and 531 are identical other than the positions at which they are disposed, and thus when explaining their common configuration, the reference codes (1) to (3) will be appropriately omitted. In the present embodiment, the pressing members 530 and 531 are positioned on frame boards 520 and 521.

In this way, if the pressing members 530 and 531 are respectively positioned on the frame boards 520 and 521 of the transfer unit 500 such that they are positioned within the gap X on the belt edges 10*b* and 10*c* at positions outside of the image transfer region G, even if the belt edges 10*b* and 10*c* of the transfer belt 10 warp, the belt edges 10*b* and 10*c* cannot warp beyond the pressing members 530 and 531 within the gap X due to the existence of the pressing members 530 and 531. Therefore, the warping of the belt edges 10*b* and 10*c* is pressed down, and thus there is no contact between the transfer belt 10 and the process cartridge units 18Bk, 18C, 18M, and 18Y even when attaching/detaching the transfer unit 500 or the process cartridge units 18Bk, 18C, 18M, and 18Y to/from the copier body 100. Accordingly, breakage of the transfer belt 10 can be prevented and the attachment/detachment operation of the units can be smoothly carried out, and this also contributes to improving the operability. Also, by providing the pressing members 530 and 531 to the transfer unit 500 including the transfer belt 10, any variability that may occur during assembly can be reduced compared to providing the pressing members 530 and 531 to another unit, and warping of the belt edges 10*b* and 10*c* can be accurately pressed down.

In the present embodiment, the pressing members 530 and 531 are disposed such that there are three on each side in the belt travel direction V. However, the pressing members 530 and 531 can also be disposed such that there are two on each side, and should be disposed such that there is at least one on each side. If there is one on each side or two on each side, the length of each pressing member 530 and 531 in the belt travel direction V is preferably longer than in the case of three on each side so that the range over which they can press down the warped belt edges 10*b* and 10*c* is widened. Further, if one each of the pressing members 530 and 531 is disposed in the belt width direction Y, they are preferably disposed centered on an area at which the warping of the belt edges 10*b* and 10*c* is the largest.

Figure 9:
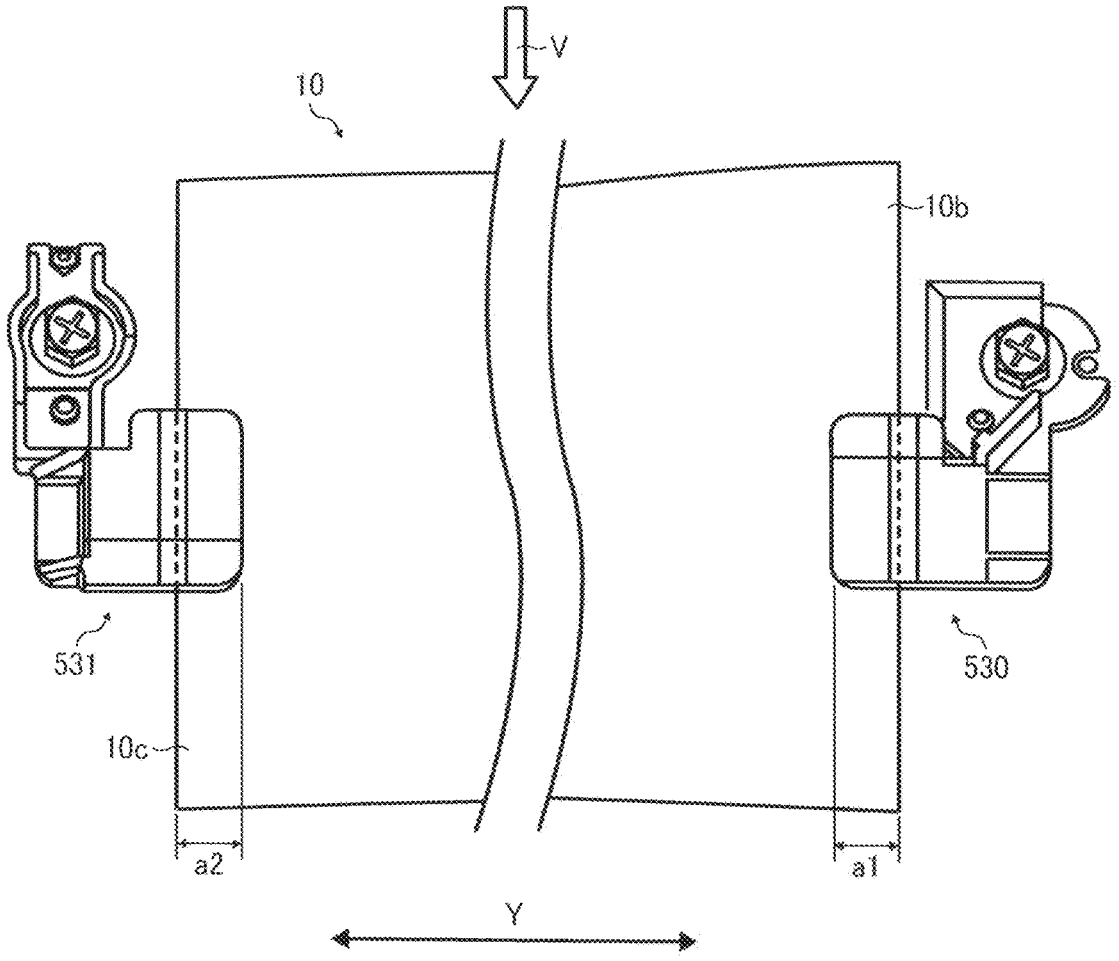
FIG. 9 is a schematic view of a configuration of a pressing member according to an embodiment of this disclosure and its positional relationship with a transfer belt (intermediate transfer belt) in a plan view.

As shown in FIG. 9, overlaps a1 and a2, which are the overlapping widths of the belt edges 10*b* and 10*c* and the pressing members 530 and 531 in the belt width direction Y, are preferably secured in an amount such that the belt edges 10*b* and 10*c* do not come out from the pressing member 530 and the pressing member 531 even if the transfer belt 10 is traveling at an incline in the belt width direction Y.

In the above-described embodiment, the pressing member 530 is disposed on the belt edge 10*b* side, and the pressing member 531 is disposed on the belt edge 10*c* side. However, in the arrangement of the pressing members, the pressing members do not have to be disposed on both edges (10*b* and 10*c*) of the transfer belt 10, and the pressing members can be arranged such that the pressing members 530 are disposed on only the belt edge 10*b* side, which is the back side of the copier body, as shown in FIG. 10, or the pressing members 531 are disposed on only the belt edge 10*c* side, which is the front side (attachment/detachment side) of the copier body, as shown in FIG. 11.

Figure 10:
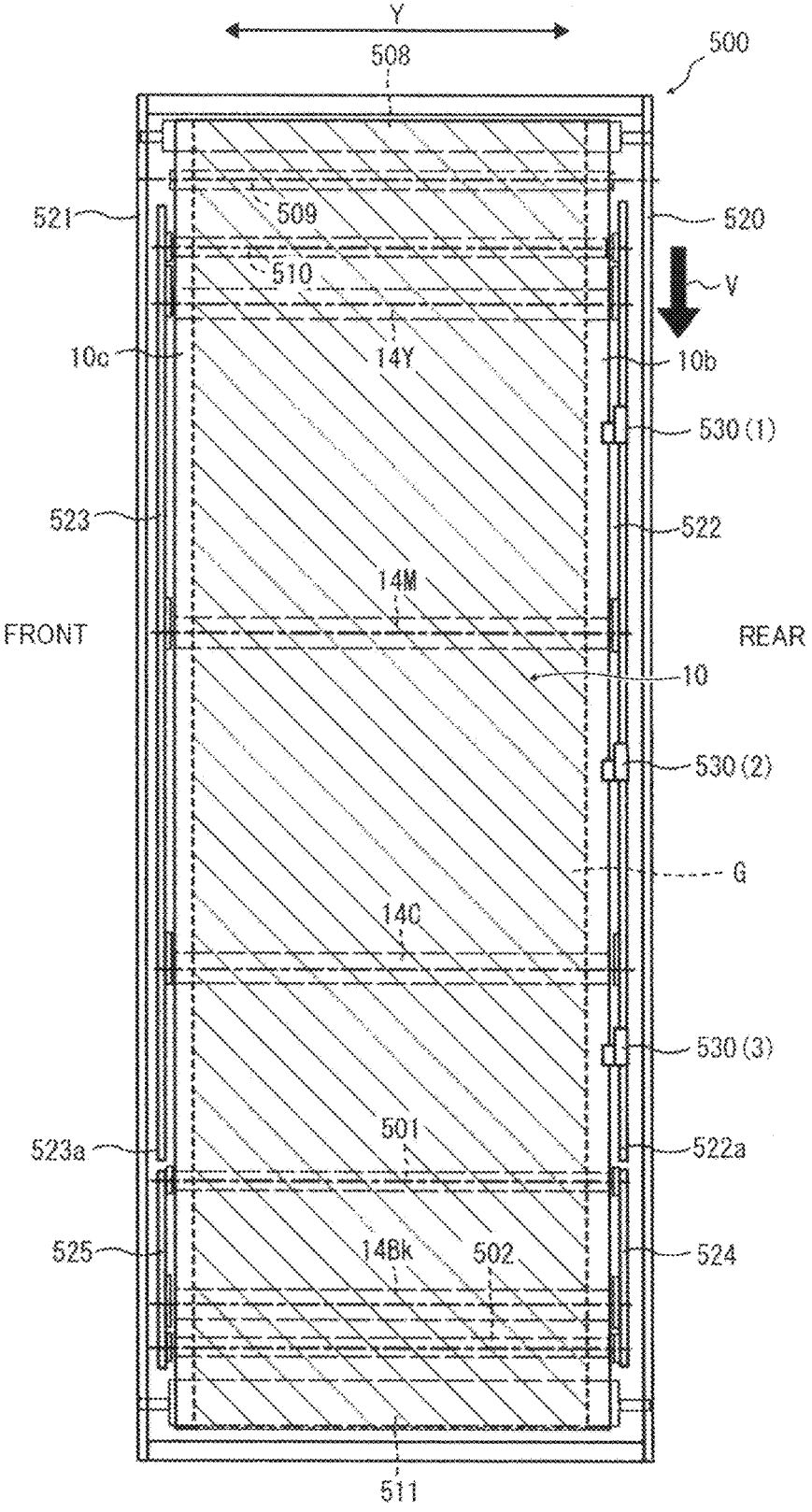
FIG. 10 is a schematic view of a configuration of the pressing member disposed at one edge of the transfer belt in a plan view.

As shown in FIG. 10, in the case that the pressing members 530 are disposed on only the belt edge 10*b* side, an effect is achieved during detachment of the process cartridge units 18Bk, 18C, 18M, and 18Y and during attachment/detachment of the transfer unit 500. If there were parts of the process cartridge units 18Bk, 18C, 18M, and 18Y on the belt edge 10*b* side that could easily catch on the transfer belt 10, since the belt edge 10*b* is pressed down by the pressing members 530, any interference between the parts of the process cartridge units 18Bk, 18C, 18M, and 18Y that could easily catch on the transfer belt 10 and the transfer belt 10 would be eliminated. Therefore, breakage of the transfer belt 10 during detachment of the process cartridge units 18Bk, 18C, 18M, and 18Y could be prevented. Also, when detaching the transfer unit 500, since warping of the belt edge 10*b* at the back side of the copier body is pressed down by the pressing members 530, any interference between the transfer belt 10 and the process cartridges would be eliminated during detachment in which the transfer unit 500 is moved from the back side of the copier body 100 to the front side or during attachment in which the transfer unit is moved from the front side to the back side, and thus breakage of the transfer belt 10 could be prevented.

Figure 11:
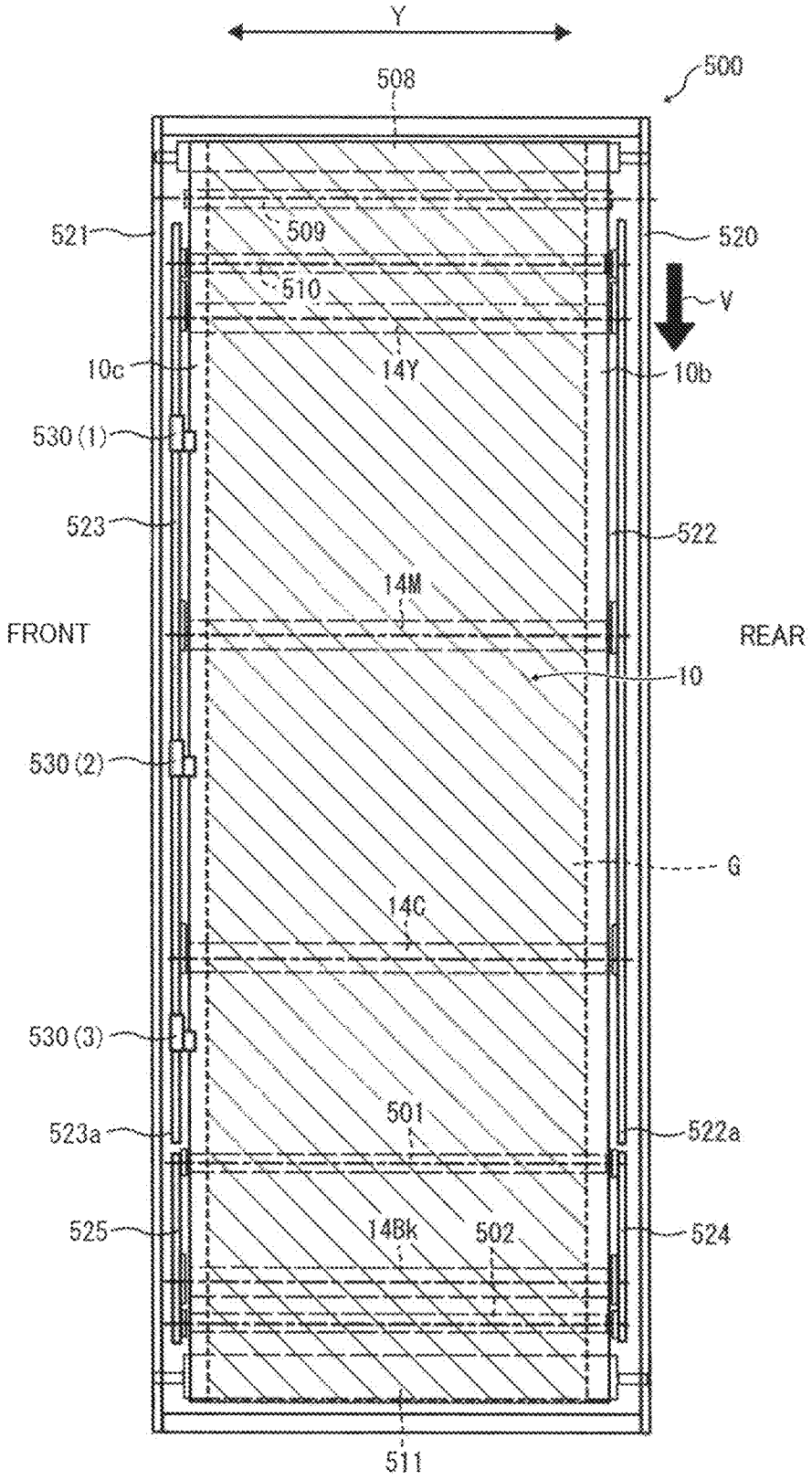
FIG. 11 is a schematic view of a configuration of the pressing member disposed at the other edge of the transfer belt in a plan view.

As shown in FIG. 11, in the case that the pressing members 531 are disposed on only the belt edge 10*c* side, which is the front side (attachment/detachment side) of the copier body, an effect is achieved during detachment of the process cartridge units 18Bk, 18C, 18M, and 18Y and during detachment of the transfer unit 500. If there were parts of the process cartridge units 18Bk, 18C, 18M, and 18Y on the belt edge 10*c* side of the transfer belt 10 that could easily catch during attachment/detachment, as long as these parts that could easily catch are installed at the front side (attachment/detachment side) of the copier body, even if warping occurred on the belt edge 10*c* at the front side, the warping would be pressed down by the pressing members 531. Thus, the process cartridge units 18Bk, 18C, 18M, and 18Y would be prevented from catching on the belt edge 10*c*, and breakage of the transfer belt 10 could be prevented. Also, when detaching the transfer belt 10, even if warping occurred on the belt edge 10*c*, which is at the front side during detachment, the warping would be pressed down by the pressing members 531. Thus, the transfer belt 10 would be prevented from catching on the process cartridge units 18Bk, 18C, 18M, and 18Y, and breakage of the transfer belt 10 could be prevented.

Figure 12A:
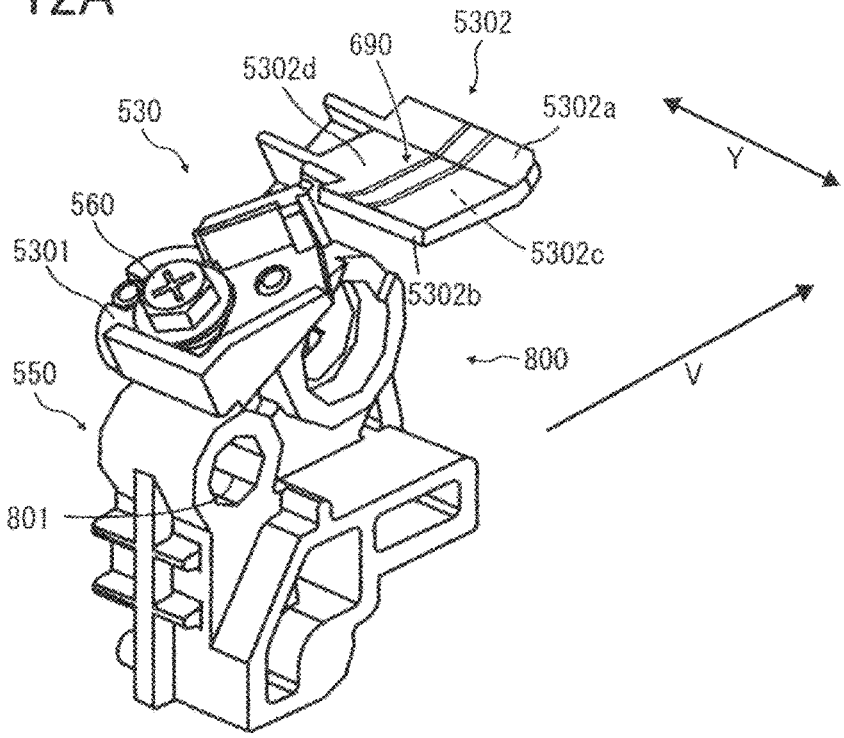
FIG. 12A is an enlarged perspective view of a configuration of the pressing member disposed at one edge side of the transfer belt.
Figure 12B:
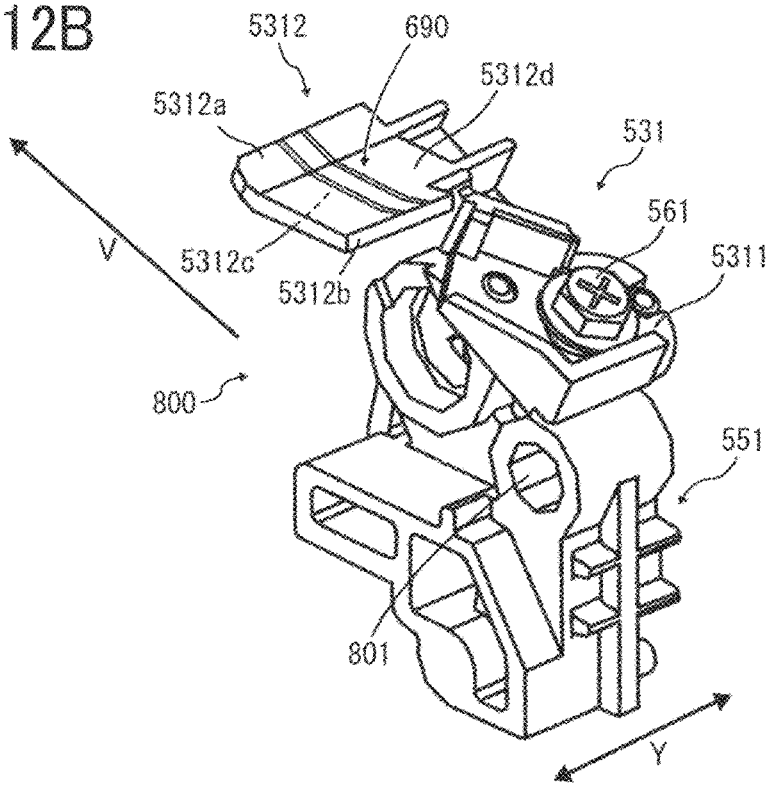
FIG. 12B is an enlarged perspective view of a configuration of the pressing member disposed at the other edge side of the transfer belt.

Next, the specific configuration of the pressing members 530 and 531 and the support roller 510 and a contact-and-separation assembly 600 thereof, as well as a contact-and-separation assembly 700 of the support rollers 501 and 502 will be explained. The contact-and-separation assembly 600 rotates the pressing members 530 and 531 and the support roller 510 toward and away from the transfer belt 10. The contact-and-separation assembly 700 rotates the support rollers 501 and 502 toward and away from the transfer belt 10. As shown in FIG. 12A, each pressing member 530 includes a mount 5301 and a pressing part 5302 that opposes the belt edge, and as shown in FIG. 12B, each pressing member 531 includes a mount 5311 and a pressing part 5312. In the pressing members 530 and 531, the mounts 5301 and 5311 are respectively detachably mounted by fasteners 560 and 561 such as bolts or screws to holders 550 and 551. The pressing members 530 and 531 are preferably configured to be detachably attachable, because by doing so the pressing members 530 and 531 can be exchanged with another type of pressing member according to the type of belt that warps or the arrangement/condition thereof or replaced with a new pressing member in the case of breakage of the pressing members 530 and 531. Further, when detaching the transfer unit 500 from the copier body 100 to exchange the transfer belt 10, removing at least one of the pressing members 530 or the pressing members 531 from the holders 550 or 551 can facilitate the exchange of the transfer belt 10.

Figure 13A:
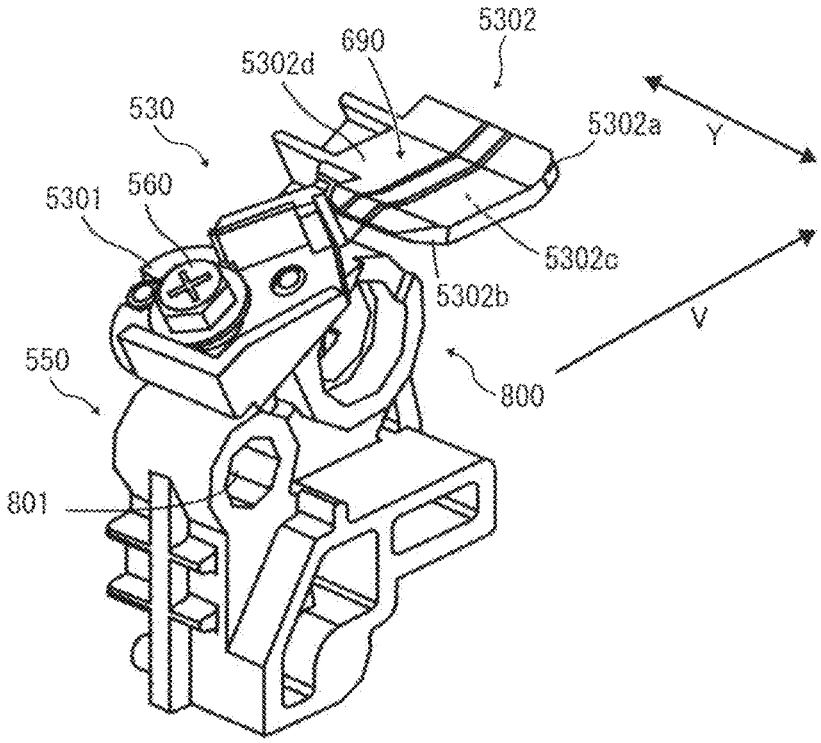
FIG. 13A is an enlarged perspective view of a variation of the pressing member disposed at one edge side of the transfer belt.
Figure 13B:
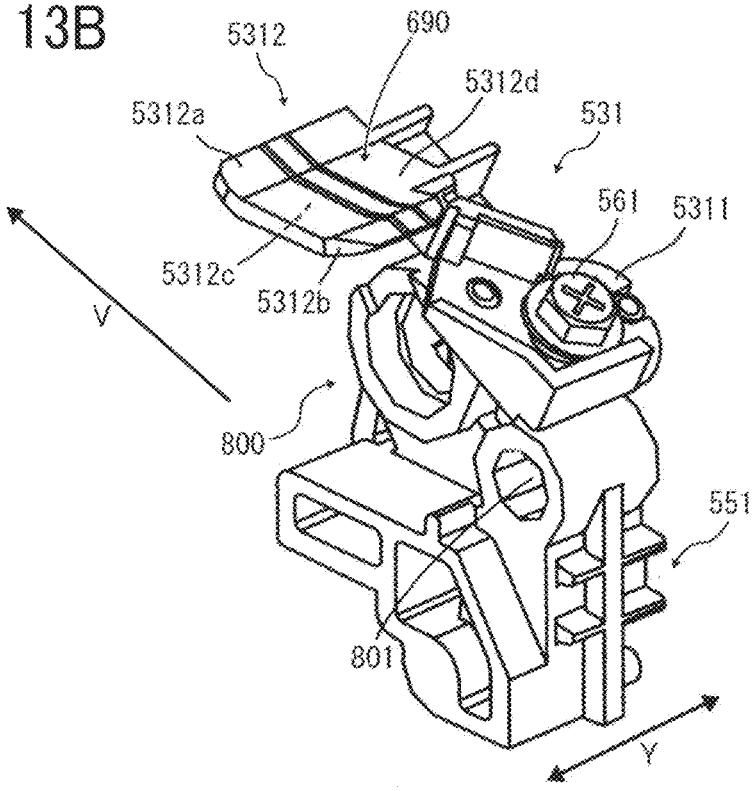
FIG. 13B is an enlarged perspective view of a variation of the pressing member disposed at the other edge side of the transfer belt.

As shown in FIGS. 12A and 12B, the pressing parts 5302 and 5312 have a panel shape that extends in the belt travel direction V, and at least one edge 5302*a*, 5312*a* that approaches the transfer belt 10 during rotation of the pressing members 530 and 531 is formed as an inclined surface that is inclined in a direction away from the top surface 10*a* of the transfer belt 10. Underside surfaces 5302*c* and 5312*c* of the pressing parts 5302 and 5312, which are the faces that oppose the transfer belt 10, are disposed so as to overlap above the belt edge 10*b* and the belt edge 10*c* opposing the belt edge 10*b* and the belt edge 10*c* of the transfer belt 10. The other edges 5302*b* and 5312*b* of the pressing parts 5302 and 5312 located on the opposite side of the edges 5302*a* and 5312*b* can be flat surfaces that are not inclined as shown in FIGS. 12A and 12B, or they can be formed as inclined surfaces that are inclined in a direction away from the top surface 10*a* of the transfer belt 10 as shown in FIGS. 13A and 13B. Also, the underside surface 5302*c*, 5312*c* sides that contact the transfer belt 10 and the corners/edges of the edges 5302*a* and 5312*a* are preferably worked to be beveled or curved so that they will not easily scratch the transfer belt 10 when contacting the belt edges 10*b* and 10*c*.

As shown in FIG. 8, the transfer unit 500 includes a pair of frame boards 520 and 521 that oppose each other in the belt width direction Y. On the frame board 520, a slider 522 that constitutes the contact-and-separation assembly 600, which causes the pressing member 530 and the support roller 510 to perform the contact-and-separation operation, and a slider 524 that constitutes the contact-and-separation assembly 700, which causes the support rollers 501 and 502 to perform the contact-and-separation operation, are aligned in parallel in the belt travel direction V. On the frame board 521, a slider 523 that constitutes the contact-and-separation assembly 600, which causes the pressing member 531 and the support roller 510 to perform the contact-and-separation operation, and a slider 525 that constitutes the contact-and-separation assembly 700, which causes the support rollers 501 and 502 to perform the contact-and-separation operation, are aligned in parallel in the belt travel direction V. The slider 522 and the slider 523 are disposed opposing each other and constitute sliders for color, and the slider 524 and the slider 525 are disposed opposing each other and constitute sliders for black. The color sliders 522 and 523 and the black sliders 524 and 525 are respectively supported by the frame boards 520 and 521 such that they can move parallel to each other in the belt travel direction V. The configuration related to the color sliders 522 and 523 will be explained below as a color-side configuration, and the configuration related to the black sliders 524 and 525 will be explained below as a black-side configuration.

(Color-Side Configuration)

Figure 14:
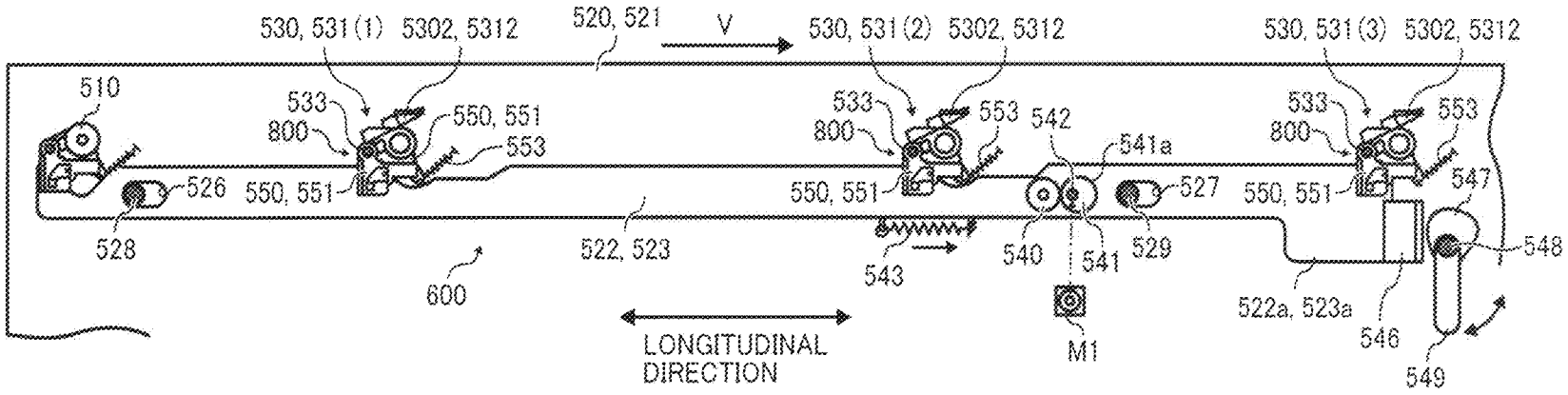
FIG. 14 is an enlarged view of a configuration of a contact-and-separation assembly of the pressing member and a support roller.

As shown in FIGS. 3 and 14, in the sliders 522 and 523, a pair of opposing long holes 526 and a pair of opposing long holes 527 that extend in the longitudinal direction are formed with intervals therebetween in the longitudinal direction. A pair of shaft-shaped pins 528 and 529 that protrude from opposing faces of the frame boards 520 and 521 are inserted into the long holes 526 and 527 to support the sliders 522 and 523 so that they can slidably move in the longitudinal direction on the frame boards 520 and 521 and to position the sliders 522 and 523 in the up-down direction. Instead of inserting pins or shafts into the long holes 526 and 527, rollers that are rotatably supported on the frame boards 520 and 521 can also be inserted. Sheet metal is used to make the sliders 522 and 523 in order to secure the rigidity thereof. However, in consideration of the friction during sliding with the pins 528 and 529, the long holes 526 and 527 themselves can be formed using a resin material with good slidability, or a resin material with good slidability can be disposed on the inside of the long holes 526 and 527 so that the pins 528 and 529 are held by the resin material so that they can slide. Alternatively, the pins 528 and 529 can be made of metal and then the outer periphery thereof can be covered or coated with a resin material with good slidability, or a lubricant such as grease can be applied to the outer periphery of the pins 528 and 529.

A pair of ball bearings 540, which serve as cam followers, are rotatably supported on the sliders 522 and 523. Outer peripheral surfaces 541*a* of a pair of contact-and-separation cams 541, which serve as contact-and-separation members, respectively contact outer peripheral surfaces 540*a* of the ball bearings 540, and thereby the sliders 522 and 523 are positioned in the longitudinal direction. The contact-and-separation cams 541 are eccentrically fixed so that they are both in the same phase on a single cam shaft 542 that is rotatably provided on the frame boards 520 and 521, and thus the contact-and-separation cams 541 rotate integrally on the same axis when the cam shaft 542 is rotated. The cam shaft 542 is driven to rotate by a driving motor M1, which serves as a driving source. A pair of tension coil springs 543, which serve as return units, are mounted at one end to the sliders 522 and 523 and the other end to the frame boards 520 and 521 to bias the sliders 522 and 523 toward the right direction (return direction) in FIG. 14.

Cam receivers 546 are formed on ends 522*a* and 523*a*, which are return-side ends, of the sliders 522 and 523. Manual cams 547 are rotatably supported by a cam shaft 548 on the frame boards 520 and 521 that oppose the cam receivers 546. A manual lever 549 for manually rotatably operating the cam shaft 548 is fixed to an end of the cam shaft 548. The manual lever 549 is disposed at the front side of the copier body.

As shown in FIGS. 3, 14, 15A, and 15B, the holders 550 and 551 that hold the pressing members 530 and 531 are rotatably supported by metal rotary support shafts 533 on the frame boards 520 and 521 of the transfer unit 500. The support portions of the holders 550 and 551 by the rotary support shafts 533 are upstream in the belt travel direction V, and the pressing parts 5302 and 5312 are disposed downstream from the support portions in the belt travel direction V. Therefore, in the pressing members 530 and 531, the pressing parts 5302 and 5312 located downstream from the rotary support shafts 533 in the belt travel direction V are rotatably supported centered on the rotary support shafts 533. The rotation direction is a direction in which the top surface 10*a* of the transfer belt 10 is made to contact or separate from the photoconductors 40Y, 40M, and 40C. Also, the direction indicated by arrow A in FIG. 15A indicates a predetermined direction, and arrow B indicates a reverse direction of the predetermined direction. Further, the transfer unit 500 is drawable from the copier body 100 in the belt width direction Y in a state in which brackets are rotated in the predetermined direction (arrow A direction) and the reverse direction (arrow B direction).

In the present embodiment, brackets 800 that are rotated by the contact-and-separation assembly 600 are formed by mounting the pressing members 530 and 531 to the holders 550 and 551. The brackets 800, which include the pressing members 530 and 531 and the holders 550 and 551, are supported on the frame boards 520 and 521, and include an opposing face (underside surface) 5302*c* and 5312*c* that opposes the top surface 10*a* of the transfer belt 10 on the outside in the belt width direction of the region G in which the image is transferred. As shown in FIGS. 12 and 13, the brackets 800 are constituted by the pressing members 530 and 531, which serve as first members and include the opposing faces (underside surfaces) 5302*c* and 5312*c*, and the holders 550 and 551, which serve as second members that hold the pressing members 530 and 531 and include holes 801 and 801 formed in the belt width direction Y. The brackets 800 are preferably configured as arms that are rotatable centered on the rotary support shafts 533 by inserting the rotary support shafts 533 shown in FIGS. 14 and 15 into the holes 801 and 801. The brackets 800 can also be configured as levers that rotate centered on the rotary support shafts 533 upon receiving a force from pins 558 and 578.

In the present embodiment, the pressing members 530 and 531 and the holders 550 and 551 are fastened by the fasteners 560 and 561 to constitute the brackets 800. However, the brackets can also be constituted by integrally molding the pressing members 530 and 531 and the holders 550 and 551. In the present embodiment, as shown in FIGS. 12 and 13, a hole 801 is provided in each bracket 800 and the rotary support shafts 533 are provided to the frame boards 520 and 521. However, instead of this configuration, the rotary support shafts 553 can be provided to the brackets 800 and the holes 801 can be provided to the frame boards 520 and 521 so as to rotatably support the brackets 800 on the frame boards 520 and 521.

In the present embodiment, openings 557 (contact faces 557A) are formed in the brackets 800 and pins 558 are provided to the sliders 522 and 523. However, instead of this configuration, the pins 558 can be provided to the bracket 800 and the openings 557 (contact faces 557A) can be formed in the sliders 522 and 523. Also, in the present embodiment, the present invention is applied to an image forming apparatus in which a toner image formed on the photoconductors 40Bk, 40C, 40M, and 40Y is transferred to a transfer belt 10, which serves as a belt. However, the constitution of the apparatus is not limited thereto. For example, the present invention can also be applied to an apparatus in which a paper sheet P is conveyed between the photoconductors 40Bk, 40C, 40M, and 40Y and a conveyance belt, which serves as a belt, and then the toner image formed on the photoconductors 40Bk, 40C, 40M, and 40Y is transferred to the paper sheet P. Further, the present invention can be applied to a monochrome image forming apparatus instead of a color image forming apparatus.

In the present embodiment, the pressing members 530 and 531 are positioned on the frame boards 520 and 521. In this positioning, in the state shown in FIG. 15A, the position of the rotation center of the bracket 800 relative to the frame board 520 can be accurately determined by inserting the rotary support shaft 533 provided to the frame board 520 into the hole 801 formed in the bracket 800. The accuracy can be improved to the extent that no other parts are interposed between the frame board 520 and the bracket 800. In other words, the rotary support shaft 533 constitutes a main reference of the bracket 800 relative to the frame board 520. Also, since a stopper 555 provided to the frame board 520 and a contact part 556 formed on the bracket contact each other, the rotation angle (the amount of rotation of the pressing members 530 and 531 centered on the rotary support shafts 533) of the bracket 800 relative to the frame board 520 can be accurately determined The accuracy can be improved to the extent that no other parts are interposed between the frame board 520 and the bracket 800. In other words, the stopper 555 constitutes a sub reference of the bracket 800 relative to the frame board 520. In the state shown in FIG. 15B, the position of the rotation center of the bracket 800 relative to the frame board 520 can be accurately determined by inserting the rotary support shaft 533 provided to the frame board 520 into the hole 801 formed in the bracket 800. In other words, in the present embodiment, in both the state shown in FIG. 15A and the state shown in FIG. 15B, the bracket 800 can be accurately positioned relative to the frame board 520 by at least using the rotary support shaft 533 as a main reference of the bracket 800 relative to the frame board 520.

Figure 15A:
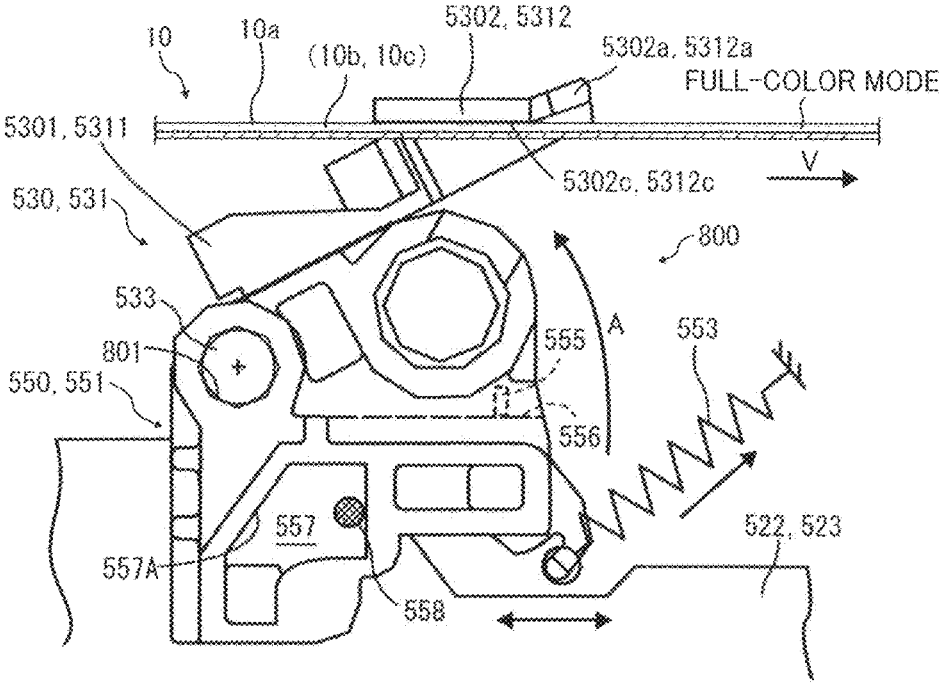
FIG. 15A is an enlarged view of a configuration of the contact-and-separation assembly of the pressing member and a first position of the pressing member.

Tension coil springs 553 are mounted at one end to the holders 550 and 551 and at the other end to the frame boards 520 and 521 to bias the holders 550 and 551 in the counter clockwise direction in FIG. 15A. As shown in FIG. 15A, contact parts 556 that contact the stoppers 555 provided on the frame boards 520 and 521 at an arbitrary position are formed on the holders 550 and 551. The stoppers 555 provided on the frame boards 520 and 521 are formed by bending the frame boards 520 and 521. Instead of by bending, the stoppers 555 can also be constituted by providing studs or the like onto the frame boards 520 and 521. The pressing members 530 and 531 are restricted from rotating in the counterclockwise direction when the contact parts 556 of the holders 550 and 551 contact the stoppers 555, and thus the pressing members 530 and 531 are held in the first position. In other words, in the positioning of the pressing members 530 and 531, the belt pressing position of the pressing members 530 and 531 can be accurately set with other members within the transfer unit 500 by contacting the contact parts 556 of the holders 550 and 551 to the stoppers 555 of the frame boards 520 and 521. The arbitrary position is the first position. In other words, in the present embodiment, the brackets 800 are positioned by contacting the contact parts 556 of the holders 550 and 551 to the stoppers 555.

The openings 557 are formed in the holders 550 and 551, and the pins 558, which are provided to the sliders 522 and 523 and serve as transmitting parts, are inserted into the openings 557. The size of the openings 557 is larger than the diameter of the pins 558, and the size is set such that the rotating operation is not obstructed when the holders 550 and 551 rotate. If the sliders 522 and 523 move from an initial position shown in FIGS. 14 and 15A toward the left direction in FIGS. 14 and 17A which is a separation direction, the pins 558 contact side surfaces 557A of the openings 557 positioned in the movement direction so as to push the holders 550 and 551. The holders 550 and 551 are rotated by the pushing operation in the clockwise direction centered on the rotary support shafts 533 to move to the second position, which is a separated position.

Figure 16A:
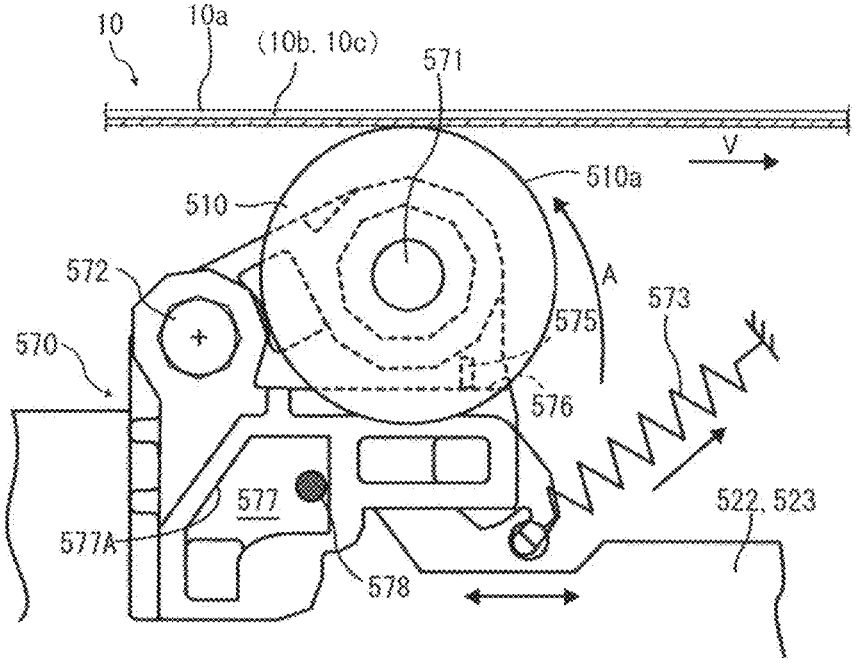
FIG. 16A is an enlarged view of a first position of a support roller on the pressing member side.

As shown in FIGS. 14 and 16A, the support roller 510 is rotatably supported by a shaft 571 on a pair of holders 570 that have the same function as the holders 550 and 551. The holders 570 are rotatably supported by metal support shafts 572 on the frame boards 520 and 521 of the transfer unit 500. Support portions of the holders 570 on the rotary support shafts 572 are disposed on the upstream side in the belt travel direction from the shaft 571 that supports the support roller 510. Therefore, the support roller 510 is rotatably supported centered on the rotary support shafts 572 on the downstream side in the belt travel direction of the rotary support shafts 572.

Tension coil springs 573 are mounted at one end to the holders 570 and at the other end to the frame boards 520 and 521 to bias the holders 570 in the counter clockwise direction in FIG. 16A. Contact parts 576 that contact stoppers 575 formed on the frame boards 520 and 521 are formed on the holders 570 that are biased in the counterclockwise direction in FIG. 16A. The support roller 510 is restricted from rotating in the counterclockwise direction when the contact parts 576 contact the stoppers 575, and thus the support roller 510 is held in the first position. Openings 577 are formed in the holders 570, and the pins 578, which are provided to the sliders 522 and 523 and serve as transmitting parts, are inserted into the openings 577. The size of the openings 577 is larger than the diameter of the pins 578, and the size is set such that the rotating operation is not obstructed when the holders 570 rotate. If the sliders 522 and 523 move from an initial position shown in FIGS. 14 and 16A toward the left direction in FIGS. 14 and 16A which is a separation direction, the pins 578 contact a side surface 577A of the openings 577 positioned in the movement direction so as to push the holders 570. The holders 570 are rotated by the pushing operation in the clockwise direction centered on the rotary support shafts 572 to move to the second position, which is a separated position. In the present embodiment, rotary movement of the pressing members 530 and 531 and the support roller 510 in the counterclockwise direction in FIG. 16 is rotation in a contact direction (the predetermined direction indicated by arrow A), and rotary movement in the clockwise direction in FIG. 16 (the predetermined direction indicated by arrow B) is rotation in a separation direction.

(Black-Side Configuration)

Figure 18A:
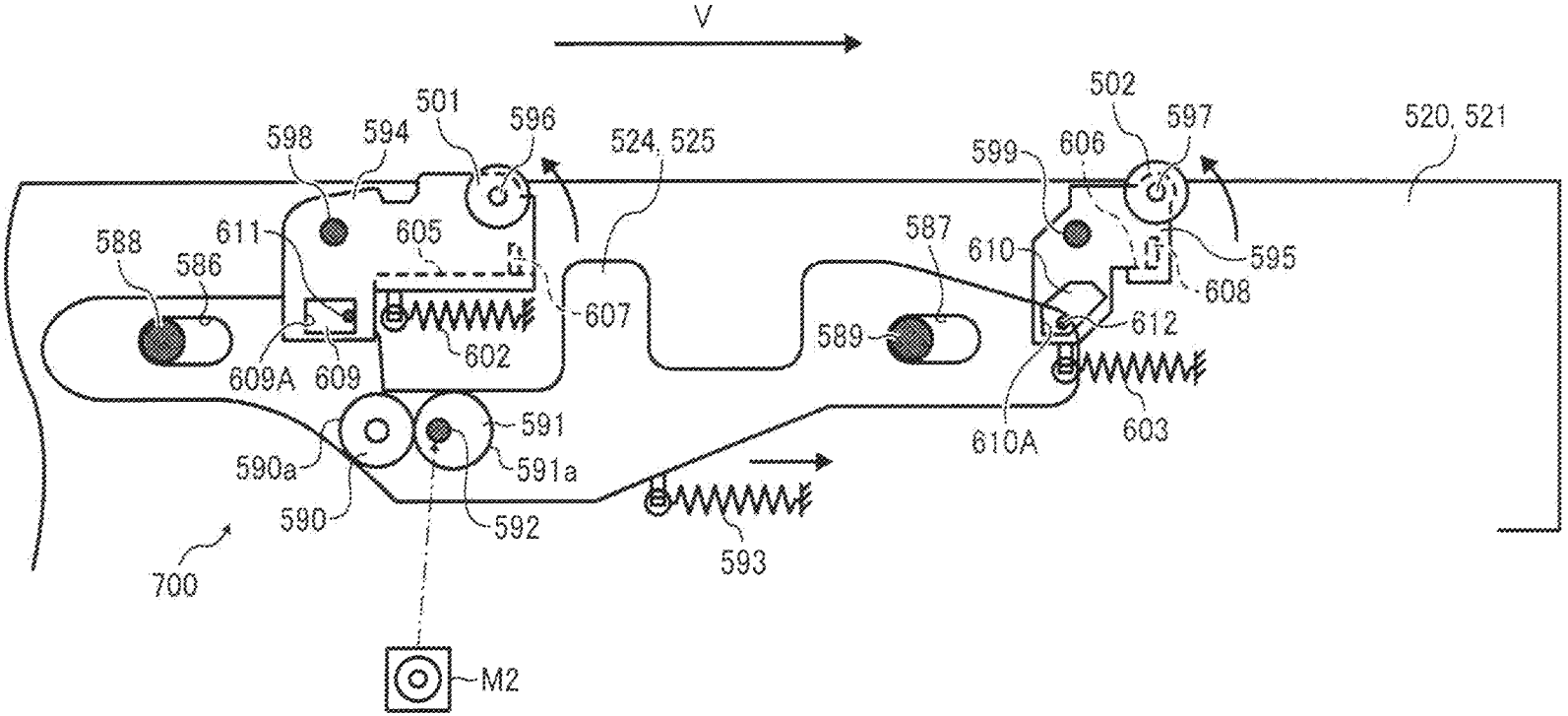
FIG. 18A is an enlarged view of the configuration and a first position of the contact-and-separation assembly of the support roller on a black side.

As shown in FIGS. 3, 14, and 18A, in the sliders 524 and 525 that constitute the contact-and-separation assembly 700, a pair of opposing long holes 586 and a pair of opposing long holes 587 that extend in the longitudinal direction are formed with intervals therebetween in the longitudinal direction. A pair of pins 588 and 589 that protrude from opposing faces of the frame boards 520 and 521 are inserted into the long holes 586 and 587 to support the sliders 524 and 525 so that they can slidably move in the longitudinal direction on the frame boards 520 and 521 and to position the sliders 524 and 525 in the up-down direction. Instead of inserting pins or shafts into the long holes 586 and 587, rollers that are rotatably supported on the frame boards 520 and 521 can also be inserted. Sheet metal is used to make the sliders 524 and 525 in order to secure the rigidity thereof. However, in consideration of the friction during sliding with the pins 588 and 589, the long holes 586 and 587 themselves can be formed using a resin material with good slidability, or a resin material with good slidability can be disposed on the inside of the long holes 586 and 587 so as to receive the pins 588 and 589 with the resin material. Alternatively, the pins 588 and 589 can be made of metal and then the outer periphery thereof can be covered or coated with a resin material with good slidability, or a lubricant such as grease can be applied to the outer periphery of the pins 588 and 589.

Figure 18B:
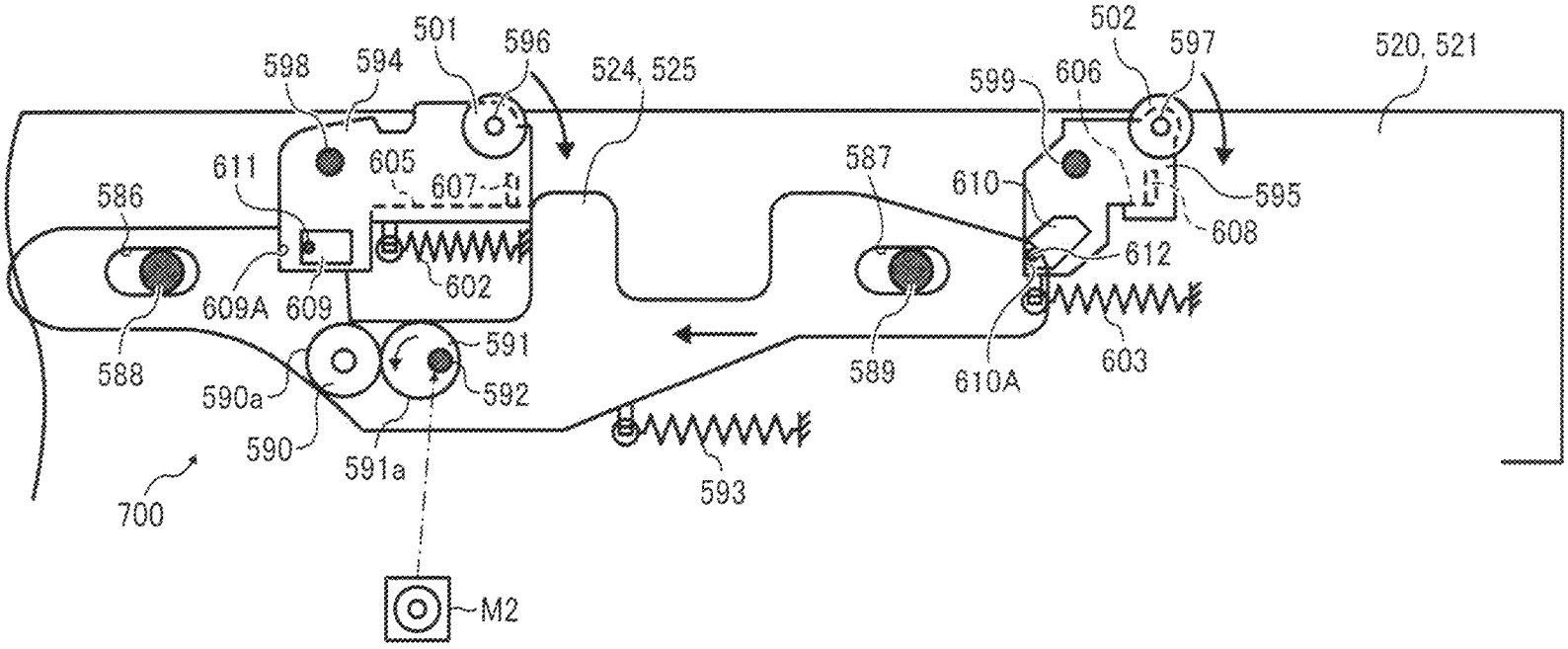
FIG. 18B is an enlarged view of the operation and a second position of the contact-and-separation assembly of the support roller on a black side.

A pair of ball bearings 590, which serve as cam followers, are rotatably supported on the sliders 524 and 525. Outer peripheral surfaces 591*a* of a pair of contact-and-separation cams 591, which serve as contact-and-separation members, respectively contact outer peripheral surfaces 590*a* of the ball bearings 590, and thereby the sliders 524 and 525 are positioned in the longitudinal direction. The contact-and-separation cams 591 are eccentrically fixed so that they are both in the same phase on a single cam shaft 592 that is rotatably provided on the frame boards 520 and 521, and thus the contact-and-separation cams 591 rotatably move when the cam shaft 592 rotates. The cam shaft 592 is driven to rotate by a driving motor M2, which serves as a driving source. A pair of tension coil springs 593, which serve as return units, are mounted at one end to the sliders 524 and 525 and the other end to the frame boards 520 and 521 to bias the sliders 524 and 525 toward the right direction (return direction) in FIG. 18.

As shown in FIG. 18A, the support rollers 501 and 502 are respectively rotatably supported by shafts 596 and 597 on pairs of holders 594 and 595 which constitute the contact-and-separation assembly 700. The holders 594 and 595 are rotatably supported by metal rotary support shafts 598 and 599 on the frame boards 520 and 521 of the transfer unit 500. Support portions of the holders 594 and 595 on the rotary support shafts 598 and 599 are disposed on the upstream side in the belt travel direction V from the shafts 596 and 597 that support the support rollers 501 and 502. Therefore, the support rollers 501 and 502 are rotatably supported centered on the rotary support shafts 598 and 599 on the downstream side in the belt travel direction from the rotary support shafts 598 and 599.

Tension coil springs 602 and 603 are mounted at one end to the holders 594 and 595 and at the other end to the frame boards 520 and 521 to bias the holders 594 and 595 in the counter clockwise direction in FIG. 18A. Contact parts 607 and 608 that respectively contact stoppers 605 and 606 formed on the frame boards 520 and 521 are formed on the holders 594 and 595 that are biased in the counterclockwise direction in FIG. 18A. The support rollers 501 and 502 are restricted from rotating in the counterclockwise direction when the contact parts 607 and 608 contact the stoppers 605 and 606, and thus the support rollers 501 and 502 are held in the first position. Openings 609 and 610 are respectively formed in the holders 594 and 595, and pins 611 and 612, which are provided to the sliders 524 and 525 and serve as transmitting parts, are inserted into the openings 609 and 610. The size of the openings 609 and 610 is larger than the diameter of the pins 611 and 612, and the size is set such that the rotating operation is not obstructed when the holders 594 and 595 rotate. If the sliders 524 and 525 move from an initial position shown in FIG. 18A toward the left direction which is a separation direction shown in FIG. 18B, the pins 611 and 612 contact side surfaces 609A and 610A of the openings 609 and 610 positioned in the movement direction so as to push the holders 594 and 595. The holders 594 and 595 are rotated by the pushing operation in the clockwise direction centered on the rotary support shafts 598 and 599 to move to the second position, which is a separated position.

The sliding operation of the sliders 522 and 523 and the sliders 524 and 525 will now be explained.

(Operation During Full Color Mode)

Figures 17A, 17B, 17C:
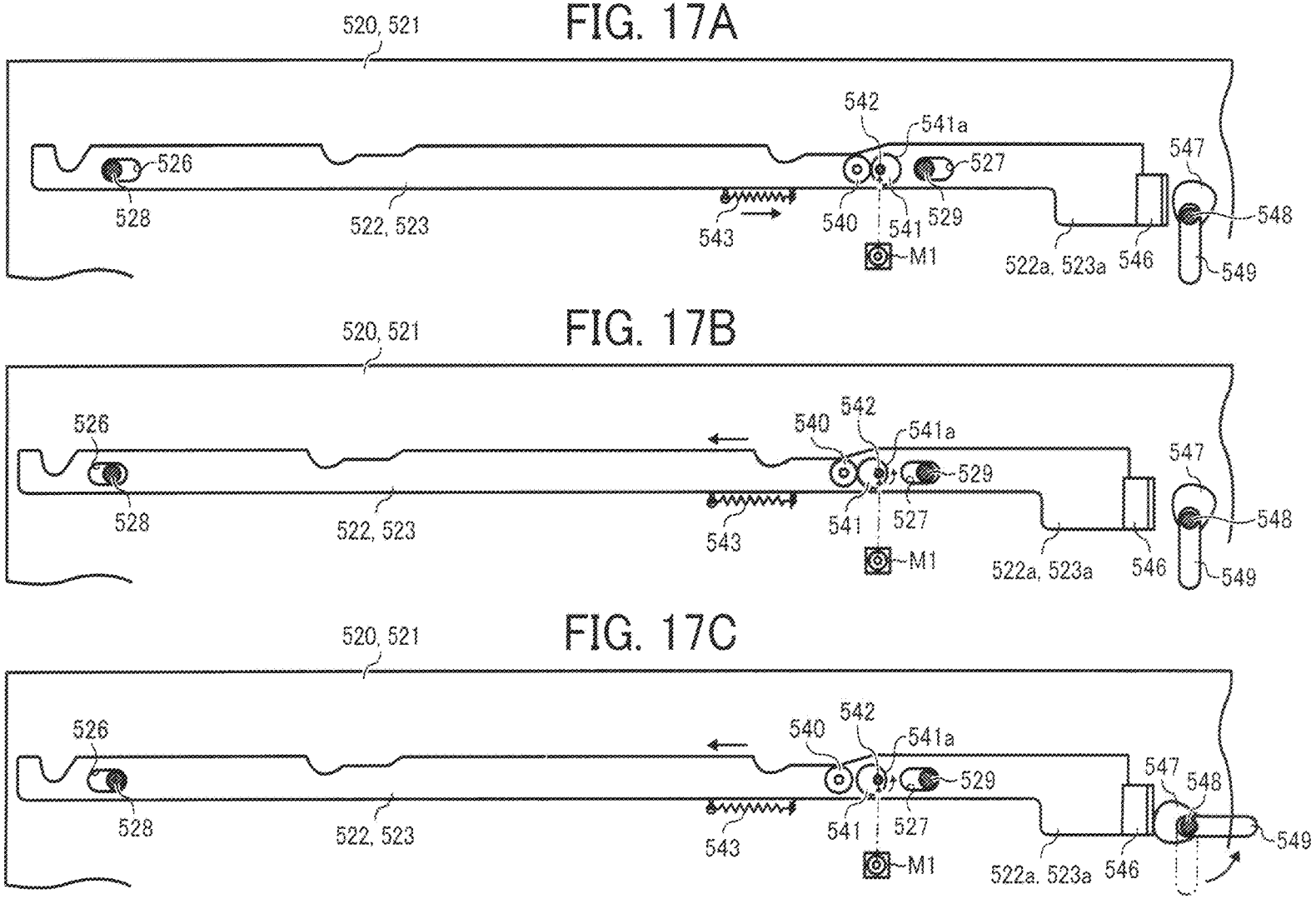
FIG. 17A is an enlarged view of the state during image formation of the contact-and-separation assembly of the pressing member and the support roller.
FIG. 17B is an enlarged view of the state during a black mode of the contact-and-separation assembly of the pressing member and the support roller.
FIG. 17C is an enlarged view of the state during an attachment/detachment mode of the contact-and-separation assembly of the pressing member and the support roller.

In the full color mode, as shown in FIG. 17A, the sliders 522 and 523 are pushed toward the right side in FIG. 17A by the action of the tension springs 543. At this time, the contact-and-separation cams 541, which are eccentric cams, contact the ball bearings 540 at a portion where the eccentric distance between the cam shaft 542 and the outer peripheral surfaces 541*a* is the shortest. Also, the manual cams 547 are in a state in which they are separated from the cam receivers 546. Thus, in the full color mode, the support roller 510 and the three groups of the first to third pressing members 530 and 531 (the brackets 800) are in the first position shown in FIG. 3. Of course, the primary transfer rollers 14Y, 14M, and 14C are also in the first position. Further, as shown in FIG. 18A, the sliders 524 and 525 are pushed toward the right side in FIG. 18A by the action of the tension springs 593. At this time, the contact-and-separation cams 591, which are eccentric cams, contact the ball bearings 590 at a portion where the eccentric distance between the cam shaft 592 and the outer peripheral surfaces 591*a* is the shortest. Therefore, in the full color mode, the support rollers 501 and 502 are in the first position shown in FIG. 3. Of course, the primary transfer roller 14Bk is also in the first position. At this time, the trajectory of the transfer belt 10 is held in an approximately horizontal trajectory.

(Operation During Black Mode)

Figure 15B:
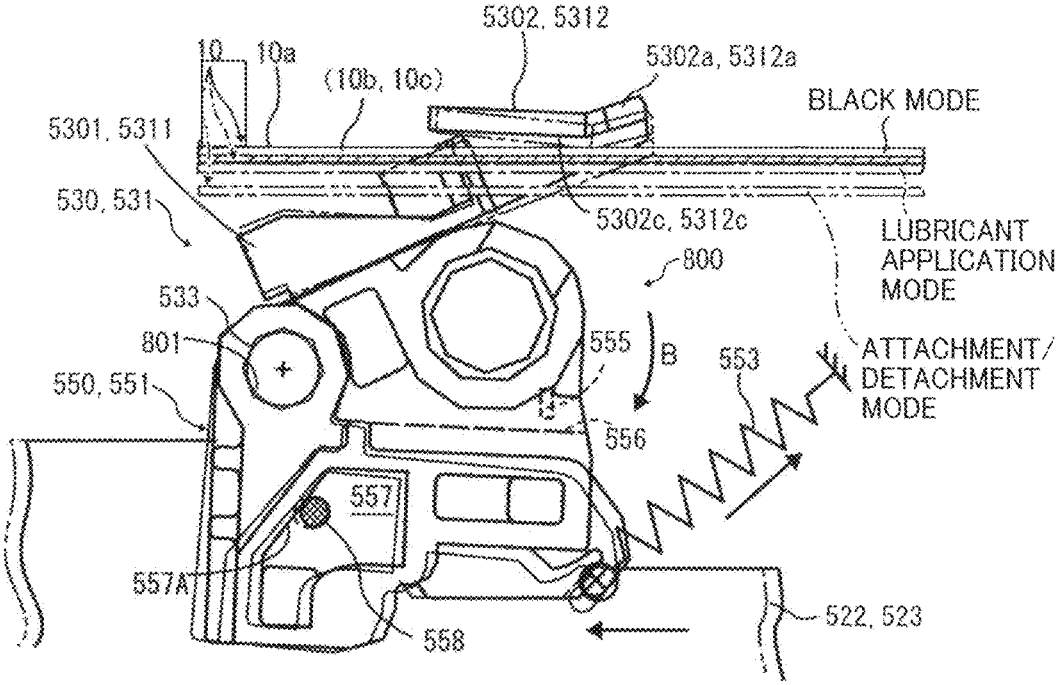
FIG. 15B is an enlarged view of the operation of the contact-and-separation assembly of the pressing member and a second and third position of the pressing member.
Figure 16B:
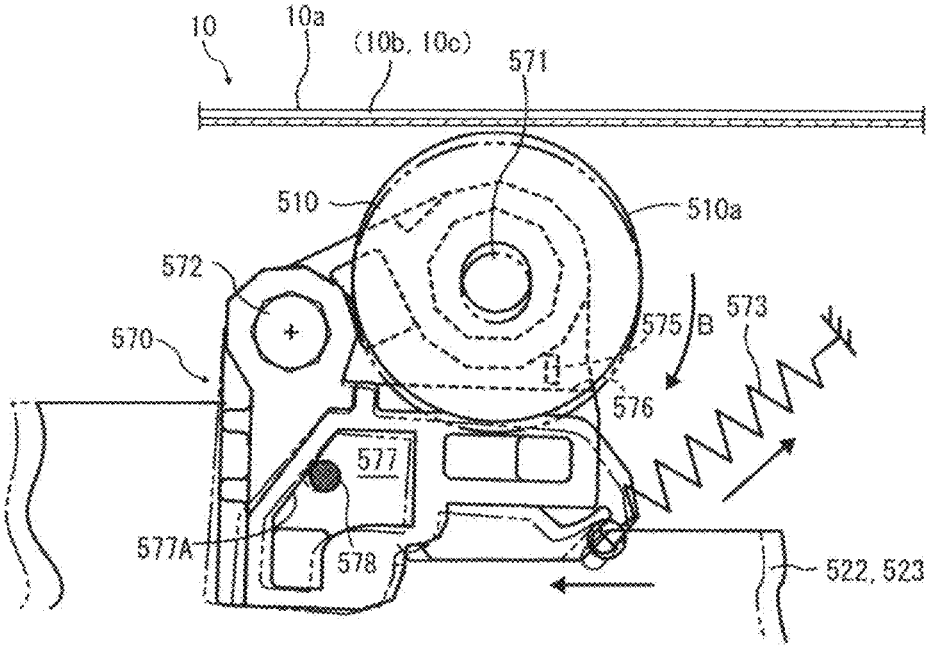
FIG. 16B is an enlarged view of a second and third position of the support roller.

In the black mode, the driving motor M1 drives the contact-and-separation cams 541 to rotate 180 degrees, and then the driving motor M1 stops. Thereby, the contact-and-separation cams 541 contact the ball bearings 540 at a portion where the eccentric distance between the cam shaft 542 and the outer peripheral surfaces 541*a* is the longest. Therefore, the sliders 522 and 523 slidingly move from the state shown in FIG. 17A toward the left side to enter the state shown in FIG. 17B. When the sliders 522 and 523 move, as shown in FIGS. 15B and 16B, the pins 558 and 578 respectively contact the side surfaces 557A and 577A of the holder openings 557 and 577 to push toward the left side. Thereby, the pressing members 530, 531, and 570 are pushed to rotate in the clockwise direction, and thus the pressing members 530 and 531 and the support roller 510 move to the second position, which is a separated position that is dropped below the first position. Further, in the black mode, the primary transfer rollers 14C, 14M, and 14Y also move from the first position to the second position shown in FIG. 4. Therefore, the trajectory of the transfer belt 10 becomes a descending trajectory as shown in FIG. 4 in which the trajectory is inclined downwards and to the left from an area of contact between the primary transfer roller 14Bk and the photoconductor 40Bk, and thus the transfer belt 10 is in the second position in which it is separated from the photoconductors 40C, 40M, and 40Y.

(Lubricant Application Mode)

In the lubricant application mode, the sliders 522 and 523 hold the pressing members 530 and 531 and the support roller 510 in the second position, and the driving motor M2 is driven. When the driving motor M2 is driven, the contact-and-separation cams 591 rotate 180 degrees as shown in FIG. 18A, and then the driving motor M2 stops. Thereby, the contact-and-separation cams 591 contact the ball bearings 590 at a portion where the eccentric distance between the cam shaft 592 and the outer peripheral surfaces 590*a* is the longest. Therefore, the sliders 524 and 525 slidingly move from the state shown in FIG. 18A toward the left side to enter the state shown in FIG. 18B. When the sliders 524 and 525 move, the pins 611 and 612 contact the side surfaces 609A and 610A of the holder openings 609 and 610 to push toward the left side. Thereby, the holders 594 and 595 are pushed to rotate in the clockwise direction, and thus the support rollers 501 and 502 move to the second position, which is a separated position that is dropped below the first position. Further, in the lubricant application mode, not only the color primary transfer rollers 14C, 14M, and 14Y but also the black primary transfer roller 14Bk also move from the first position to the second position shown in FIG. 5. Therefore, the trajectory of the transfer belt 10 becomes positioned lower than the belt trajectory in the full color mode, and the transfer belt 10 is in the second position in which it is separated from all of the photoconductors 40Bk, 40C, 40M, and 40Y.

(Separation Mode)

Figure 18C:
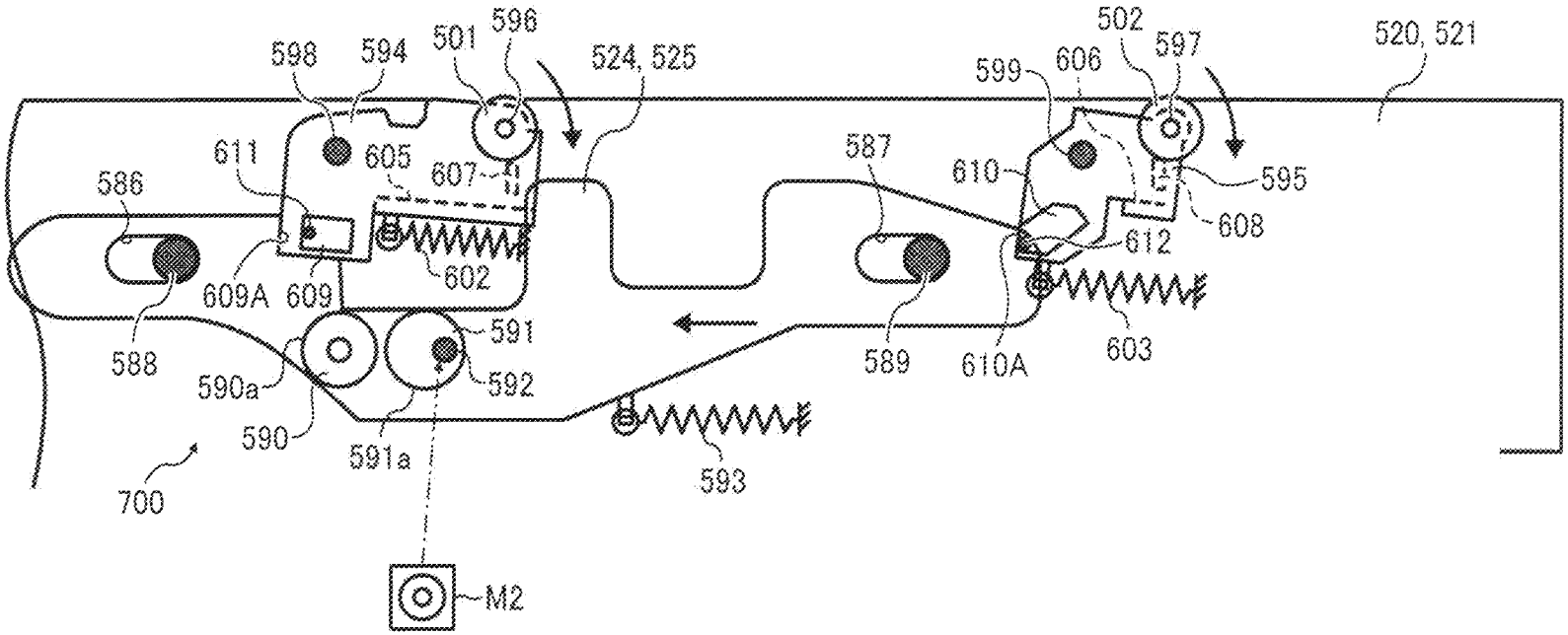
FIG. 18C is an enlarged view of the operation and a third position of the contact-and-separation assembly of the support roller on a black side.

In a separation mode, the manual lever 549 shown in FIG. 14 is operated to rotate counterclockwise, which causes the cam shaft 548 and the integrated manual cams 547 to rotate as well. Thereby, the cam receivers 546 of the sliders 522 and 523 that were pushed toward the left side by the contact-and-separation cams 541 as shown in FIG. 17B are pushed toward the left side by the manual cams 547 as shown in FIG. 17C. Therefore, as shown in FIGS. 15B and 16B, the pins 558 and 578 push the side surfaces 557A and 577A of the holder openings 557 and 577 further toward the left side so that the pressing members 530, 531, and 570 rotate further in the clockwise direction. Thereby, the pressing members 530 and 531 and the support roller 510 move from the second position indicated with solid lines to the third position, which is a separated position indicated by dot-dot-dash lines that is dropped below the second position. In other words, in the present embodiment, the trajectory of the transfer belt 10 in a mode during belt separation is not parallel to the trajectory of the transfer belt 10 during belt contact. The sliders 524 and 525 are also moved by cams further toward the left side as shown in FIG. 18C than in the position toward the left side to which they were moved by the contact-and-separation cams 591, and thus the pins 611 and 612 push the side surfaces 609A and 610A of the openings 609 and 610 further toward the left side. Thereby, the holders 594 and 595 are pushed to rotate in the clockwise direction, and thus the support rollers 501 and 502 move to the third position, which is a separated position that is dropped below the second position. Therefore, the transfer belt 10 enters a trajectory in which it is further separated from the photoconductors 40Bk, 40C, 40M, and 40Y than in the trajectory of the second position.

In this way, if the pressing members 530 and 531 that press the belt edges 10*b* and 10*c* from the belt top surface 10*a* side are provided on the frame boards 520 and 521 of the transfer unit 500, the positional accuracy between the transfer belt 10 and the pressing members 530 and 531 can be improved, and warping on the belt edges 10*b* and 10*c* can be accurately pressed down. Also, since the contact and separation of the transfer belt 10 and the pressing members 530 and 531 can be accurately managed, wear of the transfer belt 10 can be easily adjusted and the durability of the transfer belt 10 can be improved. It is also conceivable to hold the pressing members 530 and 531 with, for example, the primary transfer rollers as in the prior art. In this case, the positional accuracy with the primary transfer rollers is retained, but the most important positional relationship of the pressing members 530 and 531 is that with the belt edges 10*b* and 10*c* of the transfer belt 10. The transfer belt 10 is supported by a plurality of support rollers at portions other than the primary transfer portion, and thus if the transfer belt 10 is held on the primary transfer rollers, there may be significant accumulation of positional accuracy errors. However, by positioning the pressing members 530 and 531 on the frame boards 520 and 521 that hold the support rollers 501 to 510 that support the transfer belt 10 as in the present embodiment, the positional accuracy between the transfer belt 10 and the belt edges 10*b* and 10*c* can be improved.

If the pressing members 530 and 531 are rotatably provided on the frame boards 520 and 521 as the brackets 800 by mounting them on the holders 550 and 551, the gap X can be decreased compared to, for example, a case in which the pressing members 530 and 531 move up and down parallel to each other in the up-down direction on the frame boards 520 and 521. Also, if the pressing members 530 and 531 are supported on the primary transfer rollers, a transfer bias is applied to the primary transfer rollers, and thus a resin must be used for the support portions in order to prevent leaks. Therefore, it is necessary to set the gap X in consideration of the thermal expansion coefficient of the resin, and as a result the gap X tends to increase. If the gap X is large, the transfer unit 500 or the process cartridge units 18Bk, 18C, 18M, and 18Y may tilt during an attachment/detachment operation, leading to an increase in the frictional forces caused by contact with the transfer belt 10 or the surrounding members (units). However, if the pressing members 530 and 531 are configured to be able to rotate as in the present embodiment, at least the rotary support shafts 533 can be made of metal, and thus the thermal expansion can be reduced and the gap X can be set to be smaller than when using a resin. Accordingly, increases in the frictional forces caused by contact with the transfer belt 10 or the surrounding units due to unnecessary tilting during attachment/detachment of the process cartridge units 18Bk, 18C, 18M, and 18Y can be suppressed, and thus the units can be moved smoothly. In the present embodiment, when providing the pressing members 530 and 531 on the frame boards 520 and 521, concerns regarding bias leak are alleviated and the range of materials that can be selected is broadened, and thus the costs can also be reduced.

In the present embodiment, since a plurality of the belt pressing members 530 and 531 are disposed in the belt travel direction V, they can handle warping over a wide range of the belt edges 10*b* and 10*c*. Thus, interference between the process cartridge units 18Bk, 18C, 18M, and 18Y and the belt edges 10*b* and 10*c* that approach each other can be more reliably avoided, and breakage of the transfer belt 10 can be reduced, and this also contributes to improving the operability. Further, by disposing a plurality of the pressing members 530 and 531 in the belt travel direction V, the position of each belt pressing member 530 and 531 can be arbitrarily adjusted according to the level of warping of the belt edges 10*b* and 10*c*.

Figure 19A:
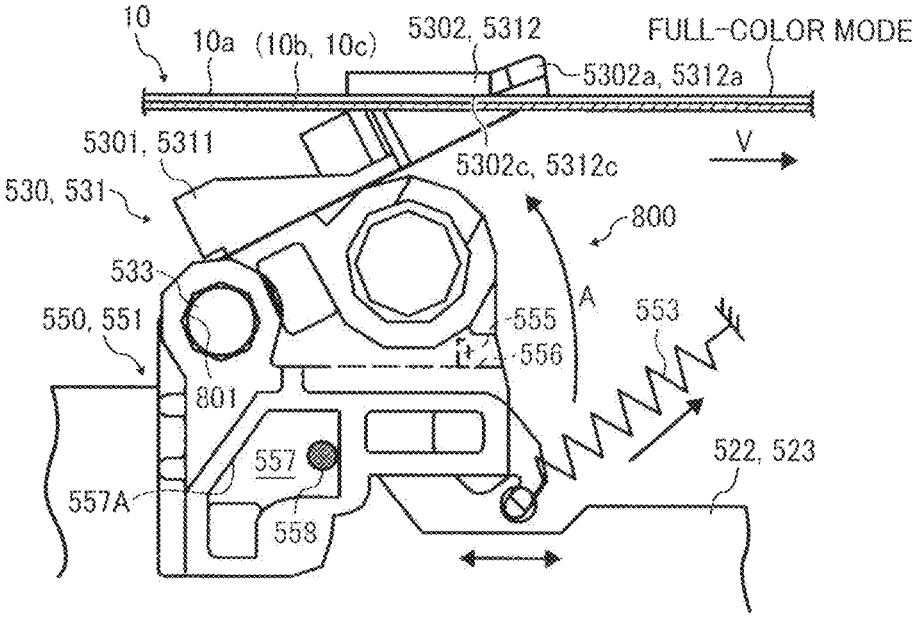
FIG. 19A is an enlarged view of a first position of a pressing member according to an embodiment of this disclosure, in which a rotation direction of the pressing member is set to a direction that follows changes in the belt trajectory.
Figure 19B:
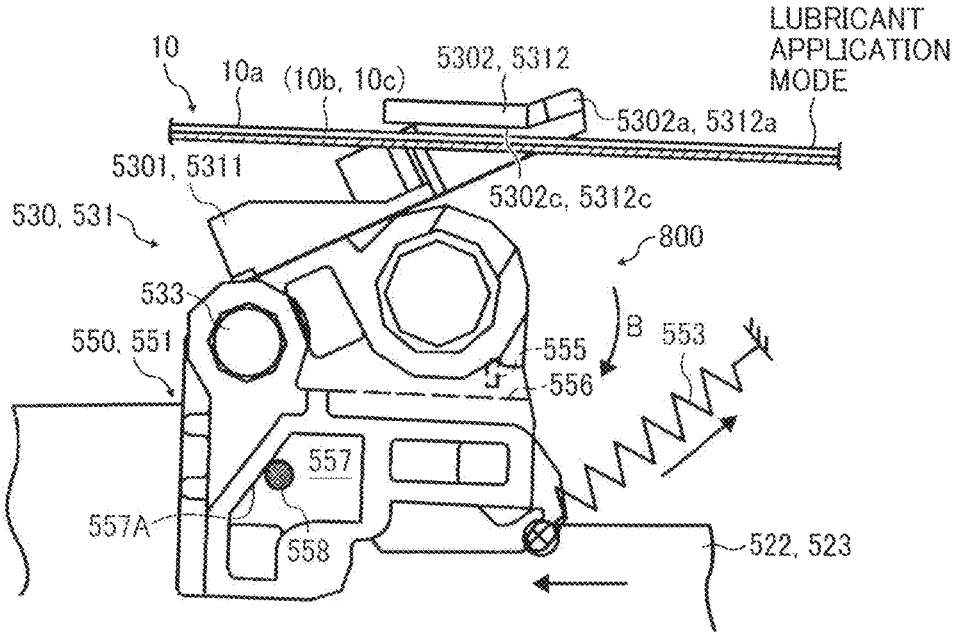
FIG. 19B is an enlarged view of a second position of the pressing member.
Figure 19C:
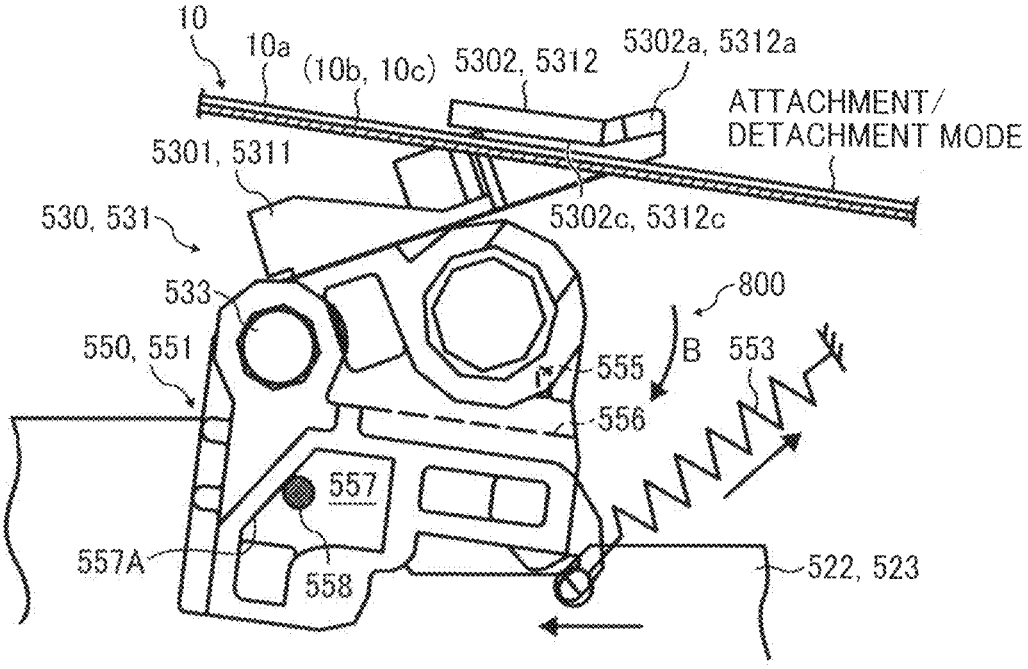
FIG. 19C is an enlarged view of a third position of the pressing member.

In the present embodiment, the trajectory of the transfer belt 10 during a contact state in which the transfer belt 10 is in contact with the photoconductors 40Bk, 40C, 40M, and 40Y differs from the trajectory of the transfer belt 10 during a separated state in which the transfer belt 10 is separated from the photoconductors 40Bk, 40C, 40M, and 40Y. However, if the pressing members 530 and 531 that press the belt edges 10*b* and 10*c* from the belt top surface 10*a* side are rotatably provided on the frame boards 520 and 521, the rotation direction of the pressing members 530 and 531 can be set to a direction that follows the changes in the belt trajectory. In other words, as shown in FIGS. 19A to 19C, if the rotation direction is set such that the angle of the pressing members 530 and 531 and the belt trajectory does not change during contact and separation, contact between the flat underside surfaces 5302*c* and 5312*c* of the pressing parts 5302 and 5312 of the pressing members 530 and 531 and the belt edges 10*b* and 10*c* can be avoided, and thus breakage of the transfer belt 10 can be better prevented.

Figure 20:
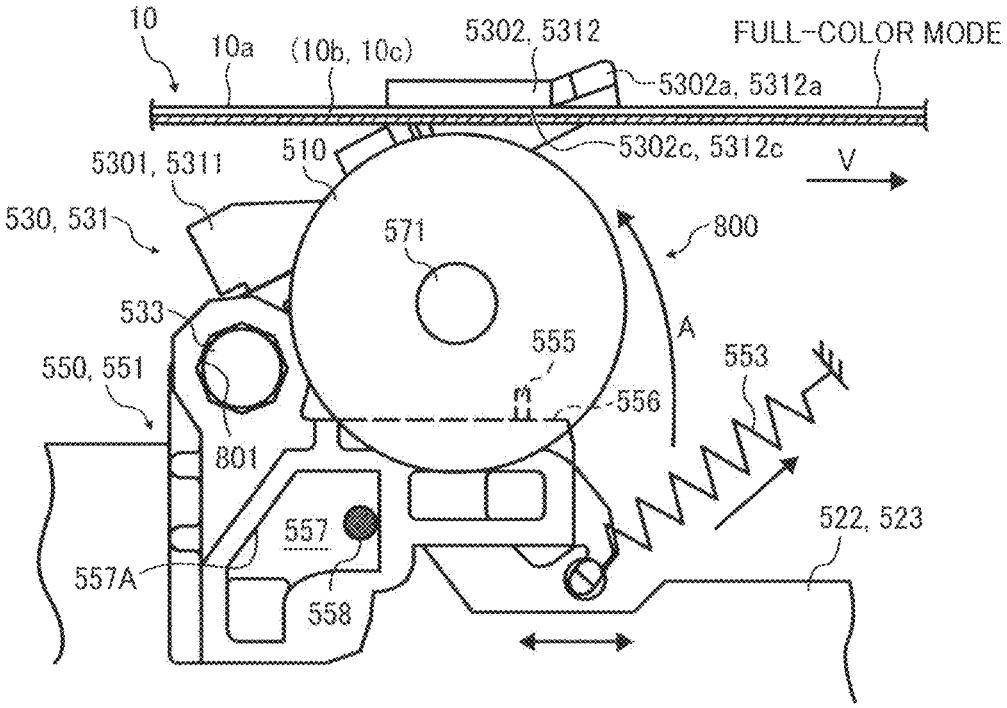
FIG. 20 is an enlarged view of an embodiment in which the pressing member and the support roller are integrated.

In the above-described embodiment, the support roller 510 and the pressing members 530 and 531 are supported by separate holders. However, for example, as shown in FIG. 20, the support roller 510 can be integrally provided by rotatably mounting the support roller 510 with the shaft 571 on the holders 550 and 551 that hold the pressing members 530 and 531. In this case, since the support roller 510, which influences the trajectory of the transfer belt 10, and the pressing members 530 and 531 are supported by the same member, the positional accuracy between the pressing members 530 and 531 and the belt edges 10*b* and 10*c* can be improved, and thus breakage of the transfer belt 10 can be better prevented.

In the above-described embodiment, the contact parts 556 provided on the holders 550 and 551 that hold the pressing members 530 and 531 are made to contact the stoppers 555 formed on the frame boards 520 and 521 to hold the pressing members 530 and 531 in the first position. However, the members on which the stoppers 555 are provided are not limited to the frame boards 520 and 521. For example, in the case that either the process cartridge units or the photoconductors are configured as units, the stoppers 555 can be provided on a base of such photoconductor units. This configuration is preferable because the pressing members 530 and 531 can be accurately arranged with members within the photoconductor units.

In the above-described embodiment, the edges 5302*a* and 5312*a* positioned on the rotation side of the pressing parts 5302 and 5312 of the pressing members 530 and 531 are inclined surfaces that are inclined in a direction away from the top surface 10*a* of the transfer belt 10. In other words, the pressing parts 5302 and 5312 of the pressing members 530 and 531 are tapered.

Figure 21:
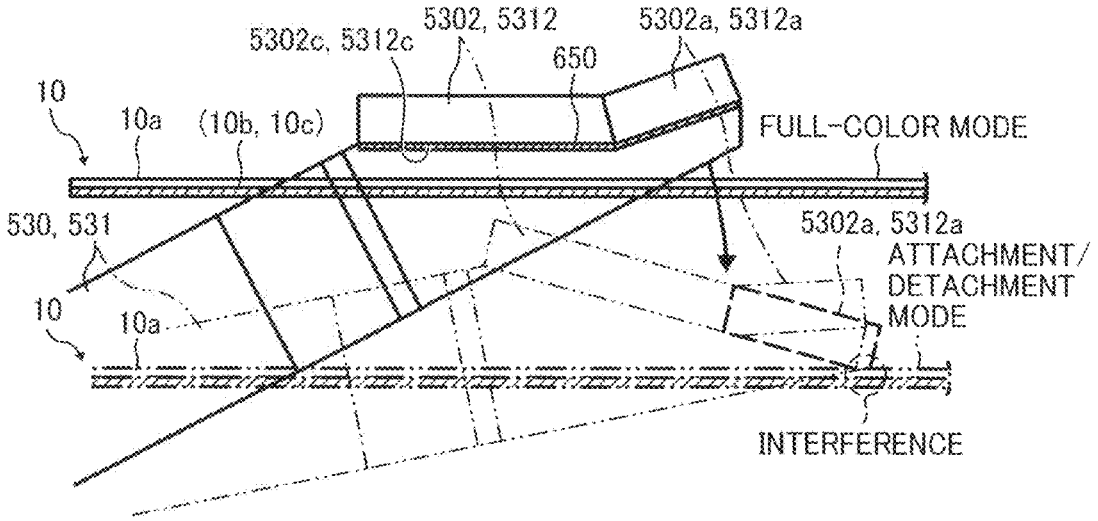
FIG. 21 is an enlarged view for explaining an interference state due to contact between the edge of the pressing member and the transfer belt and an interference avoidance state.

FIG. 21 compares a case in which the edges 5302*a* and 5312*a* are inclined surfaces and a case in which they are not inclined surfaces. In FIG. 21, the solid lines indicate the first position of the pressing members 530 and 531 and the position of the transfer belt 10 in the full color mode. The dot-dot-dash lines indicate the third position of the pressing members 530 and 531 and the position of the transfer belt 10 in the detachment mode. If the pressing members 530 and 531 are provided such that they can rotate as in the present embodiment, the movement distance increases toward the edges 5302*a* and 5312*a* of the pressing parts 5302 and 5312 which are at an area that is spaced apart from the rotation support. If the edges 5302*a* and 5312*a* are not formed as inclined surfaces, when the pressing parts 5302 and 5312 move downwards in the detachment mode, the corners of the edges 5302*a* and 5312*a* would contact the top surface 10*a* on the belt edge side as shown by the dashed lines in FIG. 21. In the detachment mode, the transfer belt 10 does not travel, and thus there would be no wear even in the state in which the corners of the edges 5302*a* and 5312*a* contact the top surface 10*a* at the belt edges. However, depending on the position of the top surface 10*a* at the belt edges and the rotation angle of the edges 5302*a* and 5312*a*, the contact state may strengthen and thus the top surface 10*a* may become recessed or a fold mark may be generated on the top surface 10*a*. Therefore, it is preferable to provide a gap to the extent possible between the pressing parts 5302 and 5312 and the transfer belt 10 (belt edges 10*b* and 10*c*), or ensure that the pressing parts 5302 and 5312 do not contact the top surface 10*a* at the corners thereof in the case that there is contact between the two. Accordingly, if the edges 5302*a* and 5312*a* of the pressing parts 5302 and 5312 are configured as inclined surfaces that are inclined in a direction away from the top surface 10*a* of the transfer belt 10, contact between the edges 5302*a* and 5312*a* and the top surface 10*a* of the transfer belt 10 can be avoided, and thus breakage of the transfer belt 10 can be reduced and the belt durability can be improved.

Figure 22:
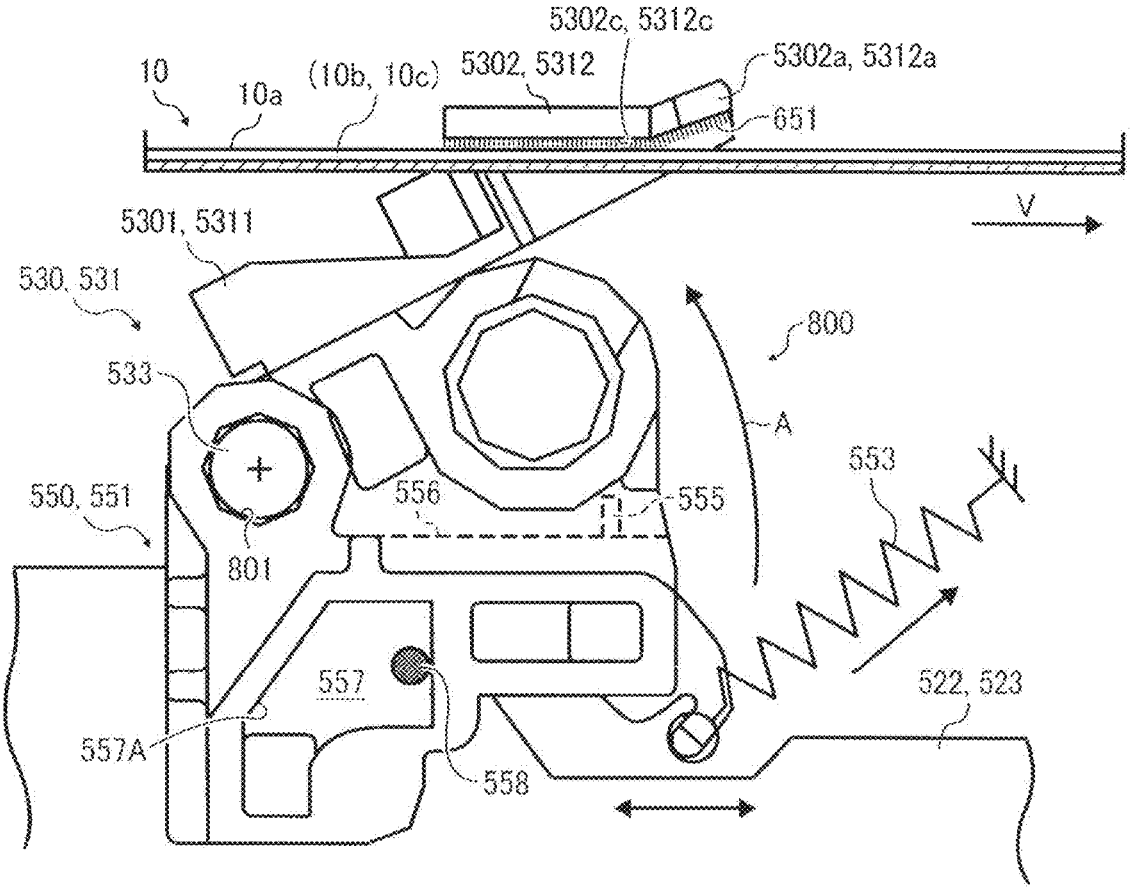
FIG. 22 is an enlarged view of an embodiment in which a seal is provided on the pressing member at an opposing portion that opposes the transfer belt.

The underside surfaces 5302*c* and 5312*c* of the pressing parts 5302 and 5312 may contact the belt edges 10*b* and 10*c* depending on the position of the transfer belt 10 and the level of warping of the belt edges 10*b* and 10*c*. Thus, a sheet 650 with good slidability is preferably adhered as a friction reducing part to the underside surfaces 5302*c* and 5312*c* that can contact the belt edges 10*b* and 10*c*. As the sheet 650, a polyethylene terephthalate sheet (PET sheet), a polyurethane sheet (PUR sheet), and the like can be used. As the friction reducing part, instead of the sheet 650, a brush-like sheet 651 on which short fibers are implanted can be adhered to the underside surfaces 5302*c* and 5312*c* as shown in FIG. 22 in order to increase the slidability between the underside surfaces 5302*c* and 5312*c* and the belt edges 10*b* and 10*c*. This configuration is preferable compared to just the sheet 650 with good slidability because the contact area is reduced and thus the frictional resistance is also reduced, and because it can be anticipated that scattered toner and paper dust that is adhered to the belt edges 10*b* and 10*c* can be easily cleaned by the short fibers.

When removing transfer belt 10 from the transfer unit 500 that has been detached from the copier body 100 to replace it with a new transfer belt and then newly resetting the new transfer belt on the support rollers 501 to 510, it is necessary to adjust the position of the belt in the depth direction. When adjusting the position of the belt in the depth direction at the back side of the copier body, the position adjustment is conducted at the belt edge 10*b* side. Thus, for example, as shown in FIGS. 12A and 13A, markings 690, which serve as a position reference for positioning the belt edge 10*b* when mounting the transfer belt 10 on the plurality of support rollers, can be provided on the pressing part 5302 of the pressing member 530. This configuration is preferable because the belt position can be easily adjusted by mounting and setting the transfer belt 10 on the support rollers such that the belt edge 10*b* is matched to the markings 690.

In the example shown in FIGS. 12A and 13A, the markings 690 are formed as two parallel lines extending in the belt travel direction on a top surface 5302*d* that is on the opposite site of the underside surface 5302*c* of the pressing part 5302. When mounting and setting the transfer belt 10, the transfer belt 10 can be easily positioned in the depth direction by setting the transfer belt 10 so that the end on the belt edge 10*b* is positioned between the two lines. Instead of the pressing part 5302, the markings 690 for positioning in the depth direction can also be formed on the pressing part 5312 of the pressing member 531 that presses the belt edge 10*c* positioned on the front side of the copier body as shown in FIGS. 12B and 13B. In this case as well, two parallel lines extending in the belt travel direction are formed on a top surface 5312*d* that is on the opposite site of the underside surface 5312*c* of the pressing part 5312. The markings 690 are not limited to two parallel lines, and can be configured as one line extending in the belt travel direction, so that the transfer belt 10 is mounted and set by matching the belt edge 10*b* or the belt edge 10*c* to this line.

The belt edges 10*b* and 10*c* of the transfer belt 10 must be disposed under the pressing parts 5302 and 5312 of the pressing members 530 and 531. From another perspective, the pressing part 5302 and the pressing part 5312 will not function if they are not disposed above the belt edge 10*b* and the belt edge 10*c*. When mounting and setting the transfer belt 10, an operation in which the belt edges 10*b* and 10*c* are slipped under the pressing members 530 and 531 must be performed. Thus, providing the markings 690 on the top surfaces 5302*d* and 5312*d* of the pressing parts 5302 and 5312 enables visual confirmation of this operation by an operator, and therefore contributes to preventing incorrect setting of the transfer belt 10.

The positional relationship between the belt edges 10*b* and 10*c* of the transfer belt 10 and the pressing members 530 and 531 will now be explained. In the above-described embodiment, the transfer belt 10 travels in the belt travel direction V when the transfer belt 10 is in the full color mode, the black mode, and the lubricant application mode. Therefore, at least in the modes in which the transfer belt 10 is in a traveling state, the underside surfaces 5302*c* and 5312*c* of the pressing members 530 and 531 and the belt edges 10*b* and 10*c* are preferably in a non-contact state. In the detachment mode, the transfer belt 10 is not in a traveling state, and thus the underside surfaces 5302*c* and 5312*c* of the pressing members 530 and 531 and the belt edges 10*b* and 10*c* are in a contact state. Therein, by pushing the warped belt edges 10*b* and 10*c* downwards, contact between the transfer belt 10 and the process cartridge units 18Bk, 18C, 18M, and 18Y can be avoided during an attachment/detachment operation of the transfer unit 500 or the process cartridge units 18Bk, 18C, 18M, and 18Y, and this also contributes to improving the durability of the transfer belt 10.

In the above-described embodiment, in the trajectory of the transfer belt 10 in the black mode, the transfer belt 10 approaches the photoconductor 40Bk as it travels from the photoconductor 40Y toward the photoconductor 40Bk side. Therefore, if the third pressing members 530(3) and 531(3) shown in FIG. 4 are moved, they might bite into the belt edges 10*b* and 10*c*. Thus, the pressing members 530(3) and 531(3) can be held in the first position, or if the pressing members 530(3) and 531(3) are moved from the first position to the second position, they can be moved into a separated state (the second position) to a position where the pressing parts 5302 and 5312 of the pressing members 530(3) and 531(3) do not bite into the belt edges 10*b* and 10*c*.

In the above-described embodiment, in the black mode, the first pressing members 530(1) and 531(1) and the second pressing members 530(2) and 531(2) are also moved from the first position to the second position so that they are in a separated state from the belt edges 10*b* and 10*c*. However, since contact between the warped belt edges 10*b* and 10*c* and the process cartridge units 18Bk, 18C, 18M, and 18Y must ultimately be avoided in the detachment mode, in other modes in which the belt edges are positioned above their position in the detachment mode, the first pressing members 530(1) and 531(1) and the second pressing members 530(2) and 531(2) do not necessarily have to be positioned in a separated position. In the above-described embodiment, the reason that the first pressing members 530(1) and 531(1) and the second pressing members 530(2) and 531(2) are moved from the first position to the second position so that they are in a separated position in the black mode is as follows. If the amount of one movement in the contact-and-separation operation is increased, a problem arises in that the diameter of the contact-and-separation cams 541 increases or the contact-and-separation torque increases. Thus, by moving the first pressing members 530(1) and 531(1) and the second pressing members 530(2) and 531(2) in advance before transitioning to the detachment mode, the movement amount to the third position decreases, and as a result increases in the diameter of the contact-and-separation cams 541 or increases in the size of the driving motor M1 can be prevented.

Figure 23:
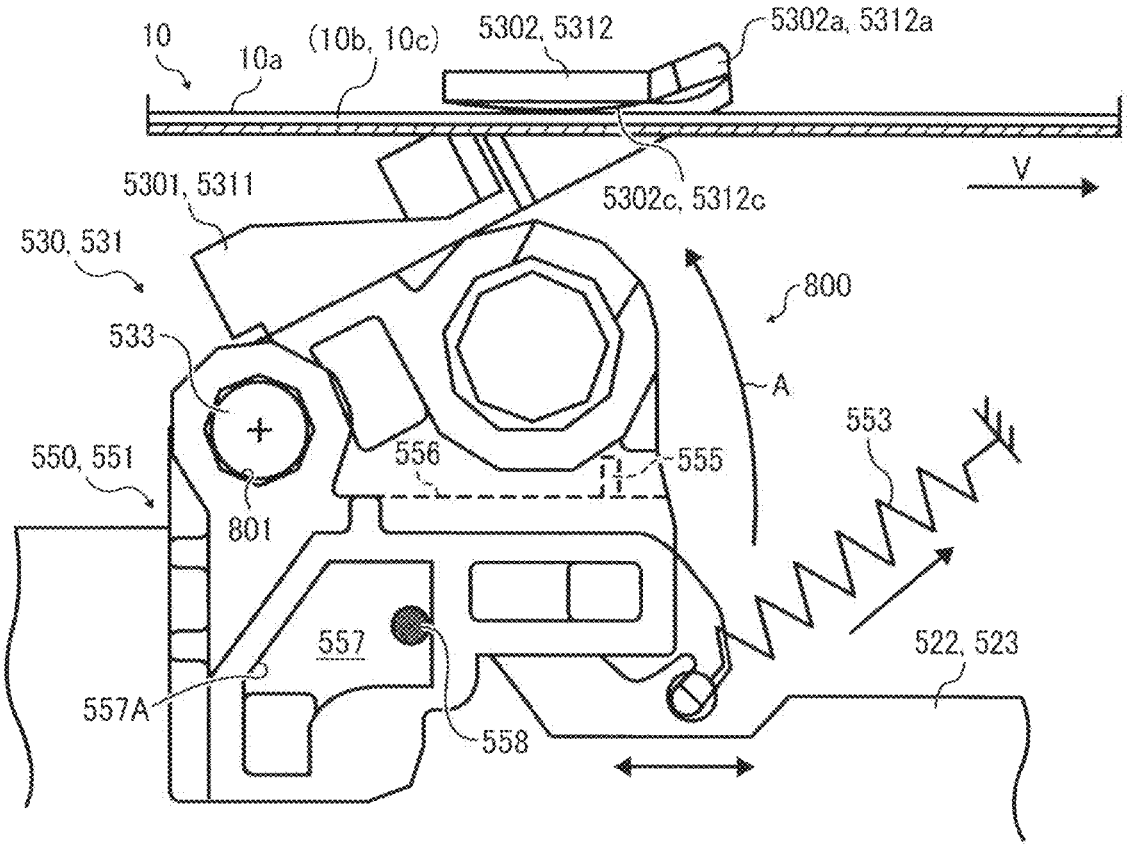
FIG. 23 is an enlarged view of an embodiment in which a portion of the pressing member that opposes the transfer belt is bent.
Figure 24:
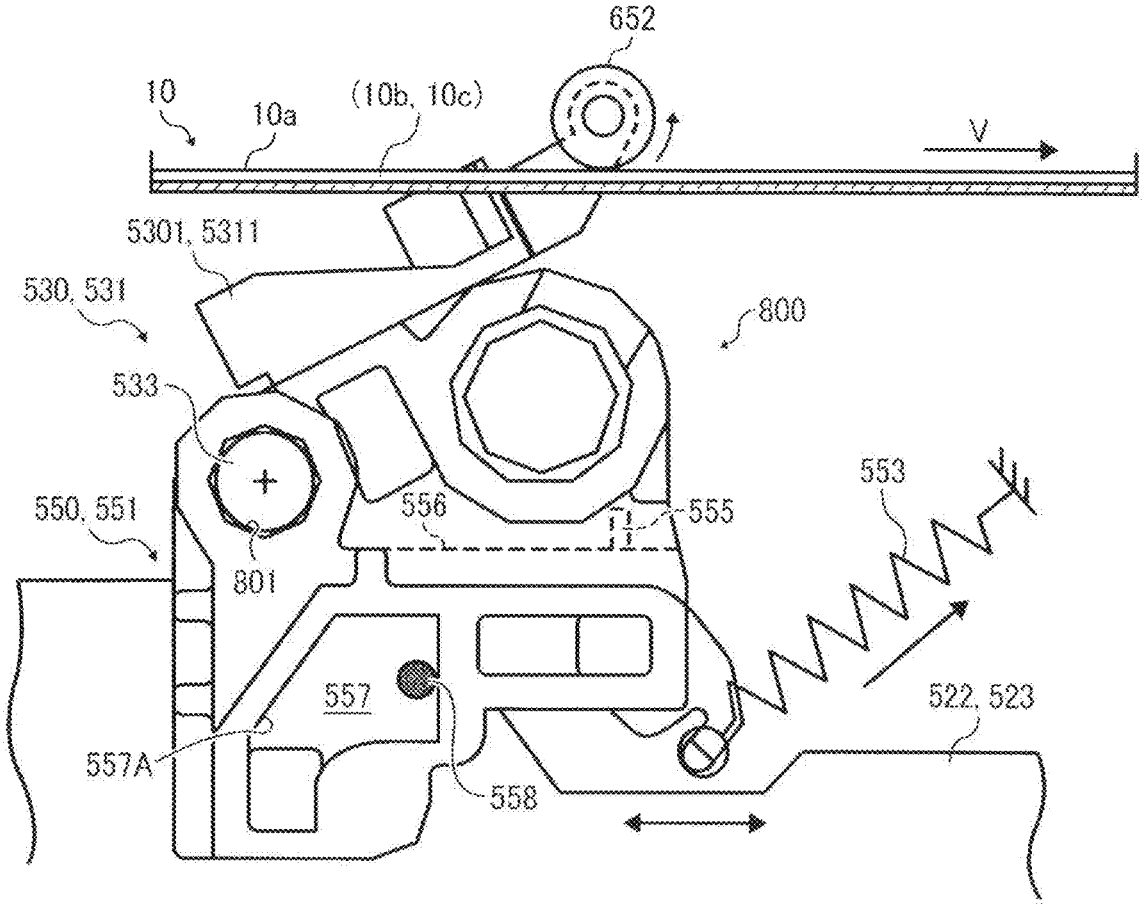
FIG. 24 is an enlarged view of an embodiment in which a portion of the pressing member that opposes the transfer belt is configured in a roller shape.

In order to reduce the frictional resistance between the warped belt edges 10*b* and 10*c* and the pressing members 530 and 531, the underside surfaces 5302*c* and 5312*c* of the pressing parts 5302 and 5312 can be formed as curved surfaces that have a bend as shown in FIG. 23 instead of flat surfaces. In other words, in FIG. 23, the curved surfaces function as friction reducing parts. Alternatively, instead of configuring the pressing parts 5302 and 5312 in a panel shape, rotator 652 that have curved circumferential surfaces and can rotate such as a roller or a roller can be provided as pressing parts on the mounts 5301 and 5311 as shown in FIG. 24. In other words, rotator 652 that can rotate can be provided on the pressing members 530 and 531 at areas opposing the belt edges 10*b* and 10*c* of the transfer belt 10.

The pressing members 530 and 531 and the support roller 510 as well as the configuration of the contact-and-separation assembly 600 thereof are not limited to an embodiment for preventing warping of the transfer belt 10 of the transfer unit 500. As applicable functional units, the above members can be applied to all units that can be detachably attachable to the copier body 100, include a traveling belt, and have other units disposed adjacent thereto. For example, the above members can be applied to a direct transfer system transfer unit in which a toner image is directly transferred to a paper sheet while the paper sheet P is being conveyed without first transferring the toner image to a transfer belt, a conveyance unit in which a belt that conveys a paper sheet P travels to convey the paper sheet, a secondary transfer unit in which a secondary transfer member is constituted by a belt, and the like, and therein the same operational effects as the present embodiment can be obtained.

Figure 25:
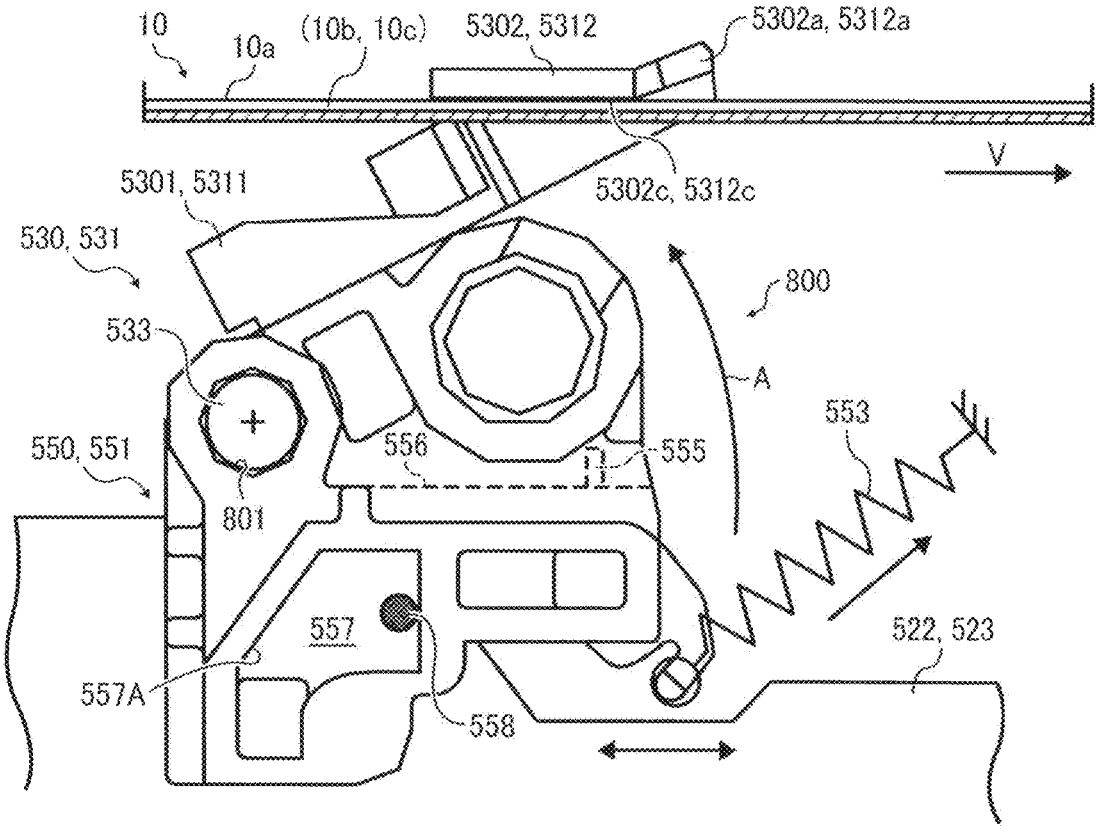
FIG. 25 is an enlarged view of another embodiment of the contact-and-separation assembly of the pressing member.

In the above-described embodiment, metal rotary support shafts 533 are provided on the frame boards 520 and 521, holes 801 and 801 are formed in the holders 550 and 551, and the rotary support shafts 533 are inserted into the holes 801 and 801. Thereby, the holders 550 and 551 are configured as arms that are rotatable centered on the rotary support shafts 533. However, the above-described embodiment is not limited to this configuration. For example, as shown in FIGS. 25A and 25B, the holders 550 and 551 can be configured as arms that are rotatable centered on the rotary support shafts 533 by forming the holes 801 and 801 in the frame boards 520 and 521, providing the metal rotary support shafts 533 at areas of the holders 550 and 551 that oppose the holes 801 and 801, and inserting the rotary support shafts 533, 533 of the holders 550 and 551 into the holes 801 and 801 of the frames. In this disclosure, examples of embodiments have been explained above, but the present invention is not limited to the specific embodiments, and various deformations and variations are possible within the scope of the present invention as recited in the claims unless otherwise specifically limited in the above explanations. The above-described effects are merely examples of the optimal effects that are achieved by at least one embodiment of this disclosure, and the effects achieved by the present invention are not limited to the above-described effects.

According to at least one aspect of this disclosure, the pressing member that presses warping on the edges of the belt is provided on the frame that supports the plurality of supports around which the belt is wound. Therefore, variations in the positional accuracy with the belt can be reduced, and the durability of the belt can be improved without enlarging the gap between adjacent units.

What is claimed is:

1. A belt unit detachably attachable to a body of an image forming apparatus, the belt unit comprising:

a belt wound around a plurality of supports to travel in a belt travel direction, the belt including a base layer, an elastic layer, and a surface onto which an image is transferred;

a pressing member to press on an edge of the belt, the pressing member including a pressing part above the surface of the belt outside a region in which the image is transferred, the pressing part having a panel shape that extends in the belt travel direction;

a frame directly connected to at least one of the plurality of supports, the pressing member being positioned on the frame;

a rotatable holder to which the pressing member is mounted;

a contact-and-separation assembly to rotate the rotatable holder and the pressing member toward and away from the belt, wherein the frame includes a shaft inserted into a hole of the rotatable holder and includes a stopper which contacts a contact part of the rotatable holder, and wherein the shaft is a main reference of the rotatable holder relative to the frame and the stopper is a sub-reference of the rotatable holder relative to the frame.

2. The belt unit according to claim 1, wherein the pressing member is positioned on the frame via the contact-and-separation assembly.

3. The belt unit according to claim 2, wherein the pressing member is positioned on the frame both when the pressing member is rotated toward the belt and when the pressing member is rotated away from the belt.

4. The belt unit according to claim 3, wherein the pressing member is positioned on the frame by the shaft.

5. The belt unit according to claim 2, wherein at least one of the plurality of supports and the pressing member are provided on the rotatable holder and mounted on the frame as a single unit.

6. The belt unit according to claim 2, wherein the pressing member is detachably provided on the rotatable holder.

7. The belt unit according to claim 2, wherein the stopper holds the rotatable holder at a position.

8. The belt unit according to claim 1, wherein the pressing member comprises an opposing face opposing the edge of the belt, and the pressing member is provided such that an angle of the opposing face to the belt is constant even if a trajectory of the belt changes.

9. The belt unit according to claim 1, wherein the pressing part opposes the edge of the belt, and the pressing part comprises a marking indicating a reference for a position at which the belt is mounted to the plurality of supports.

10. An image forming apparatus comprising the belt unit according to claim 1.

11. The belt unit according to claim 1, wherein the pressing part includes a flat surface that contacts the belt.

12. A belt unit detachably attachable to a body of an image forming apparatus, the belt unit comprising:

a belt wound around a plurality of supports to travel in a belt travel direction, the belt including a base layer and an elastic layer;

a pressing member to press on an edge of the belt, the pressing member including a pressing part having a panel shape that extends in the belt travel direction; and a frame directly connected to the plurality of supports, the pressing member being positioned on the frame, wherein the pressing part opposes the edge of the belt, at least one edge of the pressing part is inclined in a direction away from the belt, and the pressing part includes a curved surface that contacts the belt.

13. A belt unit detachably attachable to a body of an image forming apparatus, the belt unit comprising:

a belt wound around a plurality of supports to travel in a belt travel direction, the belt including a surface onto which an image is transferred ;

a pressing member to press on an edge of the belt, the pressing member including a pressing part above the surface of the belt outside a region in which the image is transferred, the pressing part having a panel shape that extends in the belt travel direction;

a frame directly connected to at least one of the plurality of supports;

a rotatable holder to which the pressing member is mounted;

a contact-and-separation assembly to rotate the rotatable holder and the pressing member toward and away from the belt, wherein the frame includes a shaft inserted into a hole of the rotatable holder and includes a stopper which contacts a contact part of the rotatable holder, and wherein the shaft is a main reference of the rotatable holder relative to the frame and the stopper is a sub-reference of the rotatable holder relative to the frame.

14. The belt unit according to claim 13, further comprising:

a transfer roller to transfer a toner image on the belt; and a driven roller disposed at a position different from the transfer roller, wherein the holder rotatably supports the driven roller.

15. The belt unit according to claim 13, wherein the pressing part includes a flat surface that contacts the belt.

16. A transfer unit comprising:

a belt wound around a plurality of rollers having a surface on which an image is transferred;

a bracket including a pressing part having a panel shape that extends in a belt travel direction, the pressing part having an opposing face above the surface of the belt outside a region in which the image is transferred, in a belt width direction;

a frame rotatably directly connected to at least one of the plurality of rollers;

a rotatable holder to which the pressing part is mounted;

a contact-and-separation assembly to rotate the rotatable holder and the pressing part toward and away from the belt, wherein the frame includes a shaft inserted into a hole of the rotatable holder and includes a stopper which contacts a contact part of the rotatable holder, wherein the shaft is a main reference of the rotatable holder relative to the frame and the stopper is a sub-reference of the rotatable holder relative to the frame, and wherein the transfer unit is drawable in the belt width direction from a body of an image forming apparatus.

17. The transfer unit according to claim 16, further comprising:

a slider; and a cam to rotate to move the slider, wherein the bracket rotates around the shaft with movement of the slider.

18. The transfer unit according to claim 17, wherein the bracket includes a contact face, the slider includes a pin, and the bracket rotates around the shaft when the pin pushes the contact face.

19. The transfer unit according to claim 16, wherein when the bracket rotates in a predetermined direction, the opposing face of the bracket moves in a direction away from the surface of the belt and the belt contacts an image bearer provided in the body of the image forming apparatus.

20. The transfer unit according to claim 19, wherein the transfer unit is drawable in the belt width direction from the image forming apparatus body in a state in which the bracket is rotated in an opposite direction of the predetermined direction.

21. The transfer unit according to claim 16, wherein the shaft and the hole extends in the belt width direction, and the shaft is inserted into the hole from the belt width direction.

22. The transfer unit according to claim 16, wherein the bracket comprises:

a first member including the opposing face; and a second member holding the first member, wherein the hole is formed in the second member.

23. The transfer unit according to claim 22, wherein the frame and the shaft are fixed relative to the image forming apparatus regardless of whether the bracket rotates.

24. The transfer unit according to claim 16, further comprising:

a transfer roller to transfer a toner image on the belt; and a driven roller disposed at a position different from the transfer roller, wherein the bracket rotatably supports the driven roller.

25. The belt unit according to claim 16, wherein the pressing part includes a flat surface that contacts the belt.

26. A transfer unit comprising:

a belt wound around a plurality of rollers having a surface on which an image is transferred;

a bracket including a pressing part having a panel shape that extends in a belt travel direction, the pressing part having an opposing face above the surface of the belt outside a region in which the image is transferred, in a belt width direction; and a frame to rotatably support at least one of the plurality of rollers, a rotatable holder to which the pressing part is mounted;

a contact-and-separation assembly to rotate the rotatable holder and the pressing part toward and away from the belt, wherein the frame includes a metal shaft inserted into a hole of the rotatable holder and includes a stopper which contacts a contact part of the rotatable holder, wherein the shaft is a main reference of the rotatable holder relative to the frame and the stopper is a sub-reference of the rotatable holder relative to the frame, and wherein the transfer unit is drawable in the belt width direction from a body of an image forming apparatus.

* * * * *